US006450253B1

(12) United States Patent
Chikuma et al.

(10) Patent No.: US 6,450,253 B1
(45) Date of Patent: Sep. 17, 2002

(54) TANK OF HEAT EXCHANGER

(75) Inventors: Hiroshi Chikuma, Kanagawa; Hiroyasu Koizumi, Yokohama; Yoshihiro Kawai, Kanagawa, all of (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 09/450,004

(22) Filed: Nov. 29, 1999

(30) Foreign Application Priority Data

| | | |
|---|---|---|
| Nov. 27, 1998 | (JP) | 10-337127 |
| Nov. 27, 1998 | (JP) | 10-337128 |
| Dec. 17, 1998 | (JP) | 10-358684 |
| Oct. 26, 1999 | (JP) | 11-303484 |

(51) Int. Cl.[7] ..... F28F 9/02
(52) U.S. Cl. ..... 165/173; 165/178
(58) Field of Search ..... 165/153, 173, 165/175, 178; 228/183

(56) References Cited

U.S. PATENT DOCUMENTS

| | | | | |
|---|---|---|---|---|
| 1,572,916 A | | 2/1926 | Gamble | |
| 2,639,899 A | | 5/1953 | Young | 257/129 |
| 3,472,316 A | * | 10/1969 | Couch, Jr. | 165/153 |
| 4,026,456 A | * | 5/1977 | Lema | 228/136 |
| 4,241,845 A | * | 12/1980 | Daly et al. | 220/203 |
| 4,509,672 A | * | 4/1985 | Woodhull, Jr. et al. | 228/175 |
| 5,662,162 A | | 9/1997 | Fukuoka et al. | 165/41 |
| 5,762,130 A | * | 6/1998 | Uibel et al. | 165/71 |
| 5,941,304 A | * | 8/1999 | Inaba et al. | 165/178 |
| 6,167,953 B1 | * | 1/2001 | Kobayashi et al. | 165/173 |

FOREIGN PATENT DOCUMENTS

| | | |
|---|---|---|
| EP | 0 718 580 | 6/1996 |
| EP | 0 821 213 | 1/1998 |
| EP | 0 825 404 | 2/1998 |
| EP | 0 854 346 | 7/1998 |
| EP | 0 860 676 | 8/1998 |
| EP | 0 863 376 | 9/1998 |
| FR | 2 681 421 | 3/1993 |
| GB | 1095731 | 12/1967 |
| GB | 1 387 673 | 3/1975 |
| GB | 2 098 313 | 11/1982 |
| JP | 57-146436 | 9/1982 |
| JP | 8-159688 | 6/1996 |
| JP | 10-206071 | 8/1998 |

* cited by examiner

*Primary Examiner*—Allen Flanigan
(74) *Attorney, Agent, or Firm*—Foley & Lardner

(57) ABSTRACT

A tank of heat exchanger comprises a tank body and a metal member. The metal member is at least one of a pipe member, a header plate member, an end plate and a filler neck member. The tank body is made of a metal and shaped like a channel member including a base wall and opposed side walls between when the base wall extends. The metal member is hermetically secured to a given portion of the tank body by partially welding the metal member to the given portion and then brazing the metal member to the given portion.

27 Claims, 24 Drawing Sheets

TANK OF HEAT EXCHANGER

BACKGROUND OF THE INVENTION

1. Field of the Invention

The present invention relates in general to heat exchangers of motor vehicles, and more particularly to a tank of the heat exchangers, which generally comprises a tank body of clad metal, a pipe member of clad metal, a header plate member of clad metal and end plates of clad metal which are all hermetically secured to one another by means of brazing.

2. Description of the Prior Art

In order to clarify the task of the present invention, some conventional tanks of heat exchangers will be described with reference to the drawings.

Referring to FIG. 41, there is shown a conventional tank of heat exchanger, which is disclosed in Japanese Utility Model First Provisional Publication 60-2195. The conventional tank comprises a tank body 1 which has a pipe inserting opening 1*a* provided by means of a burring reamer. A pipe member 2 is inserted into the pipe inserting opening 1*a* having its leading end abutting on an inner surface of the tank body 1 through a seating plate 3. However, usage of the seating plate 3 brings about a troublesome and time consuming work for producing the tank. Furthermore, due the nature of the burring reamer, the tank needs a height "H" much greater than the diameter "D" of the pipe member 2, which causes a bulky construction of the tank.

Referring to FIG. 42, there is shown another conventional tank of heat exchanger. The conventional tank comprises a tank body 1 produced by using a deep drawing technique, and a header plate member 4 brazed to the tank body 1. For facilitating the assembly, the header plate member 4 is partially fixed or welded to the tank body 1 before carrying out the brazing. However, in this conventional tank, different types of dies are needed depending on sizes and types of the tank produced by the deep drawing technique, and thus cost of the tank increases inevitably. If the tank is designed for radiators, the tank is obliged to have a larger height and longer structure making the deep drawing much difficult. Furthermore, the longer structure of the tank makes the brazing between the tank body 1 and the header plate member 4 much difficult. Furthermore, for the partial attaching between the tank body 1 and the header plate member 4, the parts 1 and 4 have to have complicated engaging and engaged portions 1*a* and 4*a* which are to be mutually engaged, which also brings about increase in production cost of the tank.

Referring to FIG. 43, there is shown still another conventional tank of heat exchanger, which is of a seam welded pipe type made of aluminum. The tank shown in FIG. 42 has a rectangular cross section. However, in this conventional tank, due to the tubular shape, formation of the opening in the tank for receiving and holding the pipe member needs a troublesome and consuming manual work.

Referring to FIGS. 44 and 45, there is shown a further conventional tank of heat exchanger, which is made of aluminum. The tank shown in the drawings comprises an aluminum tank body 1 having a generally C-shaped cross section and an aluminum header plate member 5 fitted to an open portion of the tank body 1. To both sides of a unit consisting the tank body 1 and the header plate member 5, there are fixed aluminum end plates 6 (only one is shown) respectively. As is seen from the drawings, each end plate 6 is formed with a rectangular recess 6*a* into which the corresponding end of the unit is press-fitted. The recess 6*a* of the end plate 6 and the end of the unit are brazed at "R" in a furnace. However, as is seen from FIG. 45, if the press-fitting of the unit to the end plate 6 is too hard due to a possible dimensional error therebetween or the like, the tank body 1 becomes deformed as is shown by phantom lines. Of course, in this case, brazing of such deformed portion and the end plate is not adequately carried out.

Referring to FIG. 46, there is shown a conventional structure for holding a radiator 7 to a motor vehicle (not shown) through lower and upper mount rubbers 12 and 15. The radiator 7 comprises upper and lower tanks 8 and 9 of plastics and a core structure 10 interposed between the upper and lower tanks 8 and 9. The lower tank 9 has at its lower surface mounting pins 11 by which the lower mount rubber 12 is held. The lower mount rubber 12 is held by a lower bracket 13 extending from the vehicle body. The upper tank 8 has at its upper surface mounting pins 14 by which the upper mount rubber 15 is held. The upper mount rubber 15 is held by an upper bracket 16 extending from the vehicle body. Due to provision of the upper and lower mount rubbers 15 and 12, undesired transmission of vibration of the vehicle body to the radiator 7 is lowered or at least minimized. FIG. 47 shows a conventional technique for fixing each mounting pin 14 or 11 to the upper or lower tank 8 or 9. For this fixing, the tank 8 or 9 is formed with an opening 8*a*, and each mounting pin 14 or 11 is formed with a forked projected portion 14*a*. The forked projected portion 14*a* is put in the opening 8*a* and then brazing is practically applied to mating portions therebetween. However, this pin fixing work is troublesome. Furthermore, satisfied brazing is not obtained by the pin due to a non-negligible difference in heat capacity between the mounting pin 14 or 11 and the tank 8 or 9. Of course, the unsatisfied brazing tends to induce leakage of cooling water from the tank.

SUMMARY OF THE INVENTION

It is therefore a main object of the present invention to provide a tank of heat exchanger, which is free of the above-mentioned drawbacks.

It is an object of the present invention to provide a tank of heat exchanger, wherein a pipe member is readily and assuredly connected to a tank body.

It is another object of the present invention to provide a tank of heat exchanger, which is easily manufactured at a reduced cost.

It is still another object of the present invention to provide a tank of heat exchanger, wherein end plates are assuredly brazed to ends of a unit including a tank body and a header plate member.

It is a further object of the present invention to provide a tank of heat exchanger, wherein mounting pins are readily and assuredly fixed to the tank.

According to a first aspect of the present invention, there is provided a tank of heat exchanger, which comprises a tank body made of a metal, the tank body being shaped like a channel member including a base wall and opposed side walls between which the base wall extends; and a metal member that is hermetically secured to a given portion of the tank body by partially welding the metal member to the given portion and then brazing the metal member to said given portion.

According to a second aspect of the present invention, there is provided a tank of heat exchanger, which comprises a tank body made of a clad aluminum plate, the tank body being shaped like a channel member including a base wall and opposed side walls between which the base wall extends; a circular opening formed in one of the side walls; a pipe member of a clad aluminum plate, the pipe member having a circular flange which is brazed to the one of the side walls in a manner to provide a fluid communication between the interior of the tank body and the interior of the pipe member through the circular opening; a header plate member of clad aluminum plate to which a core structure of the heat exchanger is connected, the header plate member having therealong respective flanges, the header plate member covering a longitudinally extending open portion of the tank body by having the flanges thereof brazed to inner surfaces of the opposed side walls of the tank body; and end plates of clad aluminum plate, which are brazed to longitudinal ends of the tank body.

BRIEF DESCRIPTION OF THE DRAWINGS

Other objects and advantages of the present invention will become apparent from the following description when taken in conjunction with the accompanying drawings, in which.

DETAILED DESCRIPTION OF THE EMBODIMENTS

In the following, embodiments of the present invention will be described with reference to the accompanying drawings.

For ease of understanding, various directional terms, such as, upper, lower, right, left, upward, downward and the like are used in the following description. However, it is to be noted that such terms are to be understood with respect to the drawings on which corresponding parts and structures are illustrated.

Figure 1:
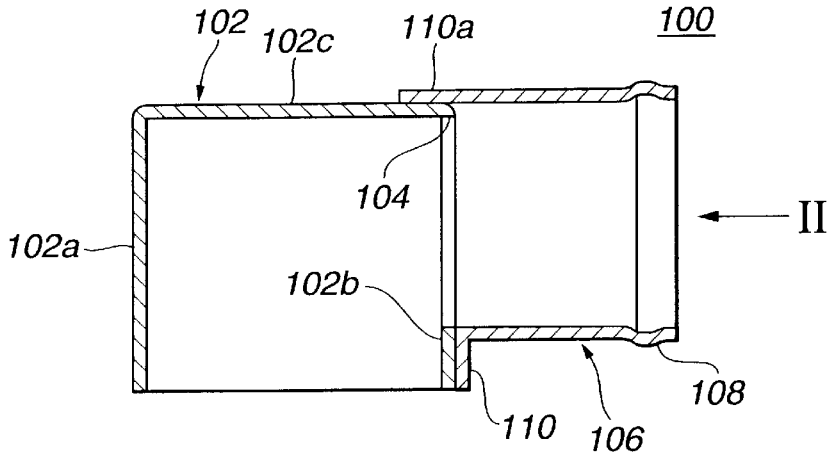
FIG. 1 is a sectional view of a tank of heat exchanger, which is a first embodiment of the present invention.
Figure 2:
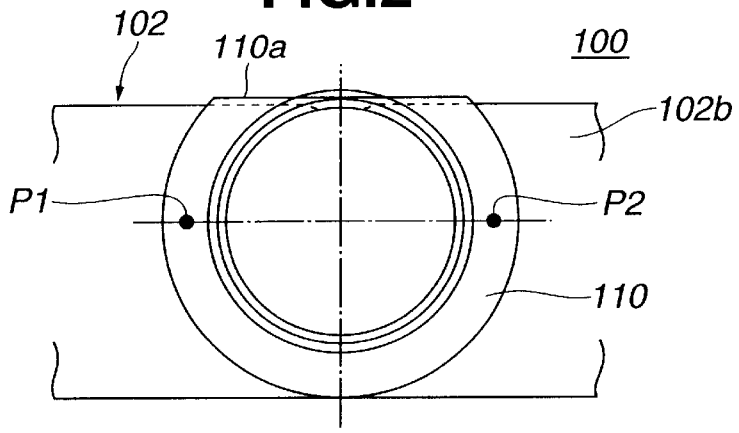
FIG. 2 is a front view of the tank of the first embodiment, that is a view taken from a direction of the arrow "II" of FIG. 1.
Figure 3:
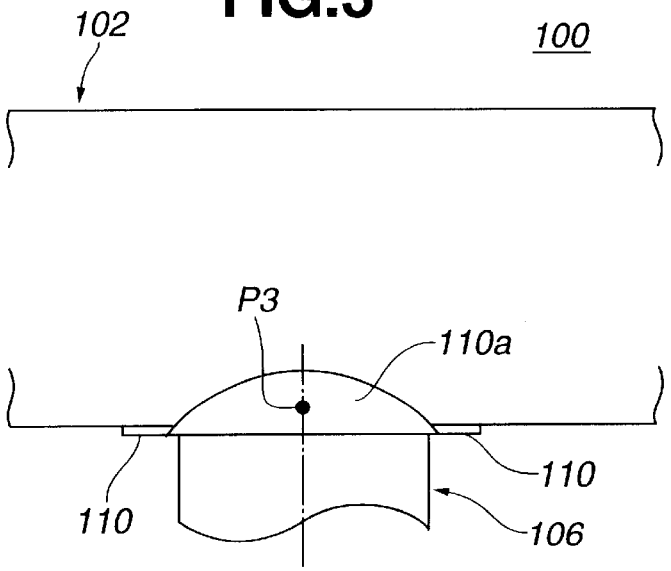
FIG. 3 is a plan view of the tank of the first embodiment.

Referring to FIG. 1 to FIG. 5E, particularly FIGS. 1 to 3 of the drawings, there is shown a tank 100 of heat exchanger, which is a first embodiment of the present invention. The heat exchanger to which the tank 100 is practically applied is a radiator which is usually mounted in a front part of an engine room for cooling an engine cooling water.

The tank 100 of this first embodiment comprises a tank body 102 which is made of a clad metal, such as a clad aluminum plate or the like. The tank body 102 is shaped like a channel member including opposed side walls 102*a* and 102*b* and an upper wall (or base wall) 102*c*. The tank body 102 has a lower portion fully opened, as shown. An inner surface of the tank body 102 is coated with a corrosion resisting material or self-sacrificing corrosion material, and an outer surface of the tank body 102 is lined with a brazing metal. The side wall 102*b* is formed with a circular opening 104. As is seen from FIG. 1, the circular opening 104 has an uppermost end that terminates at an inner surface of the upper wall 102*c*.

A pipe member 106 is connected to the circular opening 104 of the tank body 102. That is, in operation, coolant is forced to flow in the pipe member 106 and the tank body 102. The pipe member 106 is made of a clad metal, such as a clad aluminum plate or the like. Inner and outer surfaces of the pipe member 106 are coated with a corrosion resisting material or self-sacrificing corrosion material. The pipe member 106 is formed at one end with an annular ridge 108 which functions to make a tight fitting of a hose (not shown) thereto when the hose is connected to the pipe member 106.

The other end of the pipe member 106 is formed with a generally circular flange 110. The flange 110 comprises a generally circular major part which is brazed to a peripheral portion of the circular opening 104 of the side wall 102*b* and a generally arcuate upper part 110*a* which is bent at generally right angles and brazed to the upper wall 102*c*.

The pipe member 106 is produced by taking the following steps.

Figure 4A:
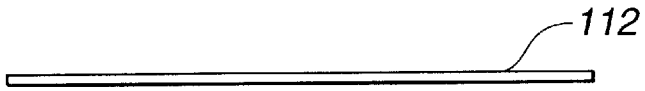
FIGS. 4A to 4D are illustrations explaining first half steps of a method of producing a pipe member used in the first embodiment.
Figure 4B:
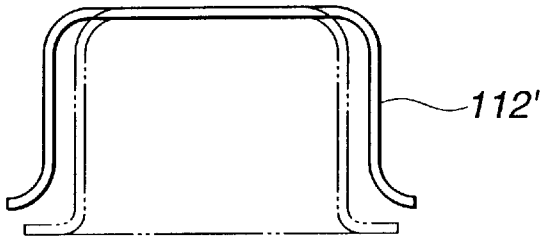
Figure 4C:
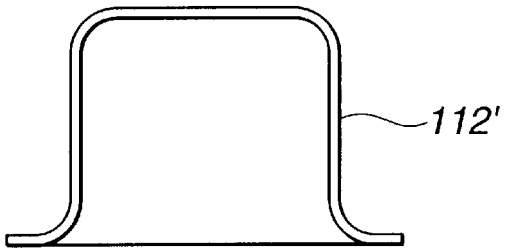
Figure 4D:
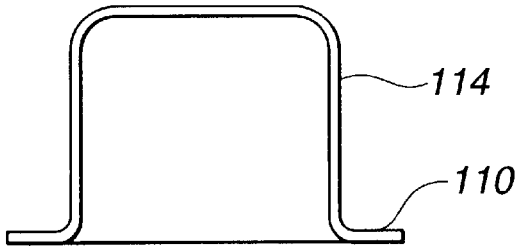
Figure 5A:
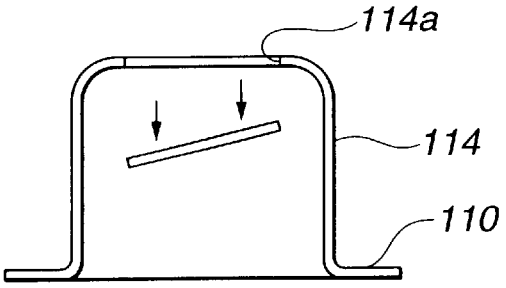
FIGS. 5A to 5E are views explaining last half steps of the method of producing the pipe member used in the first embodiment.
Figure 5B:
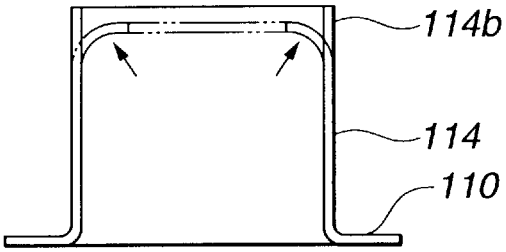
Figure 5C:
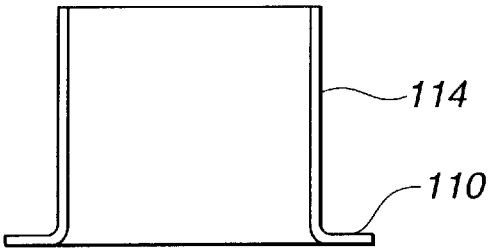
Figure 5C:
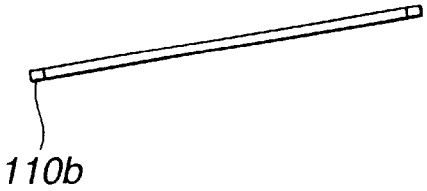
Figure 5D:
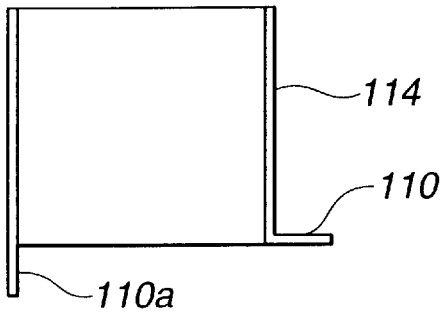
Figure 5E:
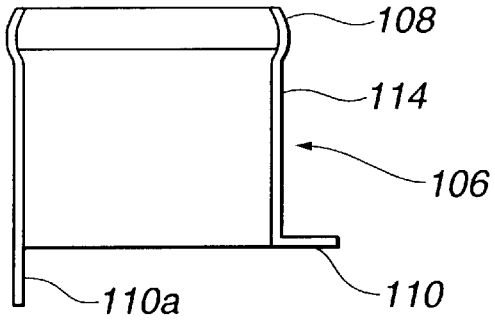

First, as is seen from FIG. 4A, a clad aluminum plate 112 is prepared. The plate 112 is then subjected to a deep drawing process as is depicted by FIGS. 4B, 4C and 4D to produce a cup-shaped member 114 with a roughly shaped flange 110. Preferably, the deep drawing process is carried out through three drawing steps. Then, as is seen from FIG. 5A, the cup-shaped member 114 is subjected to a piercing process to provide at a bottom thereof with an opening 114*a*. Then, as is seen from FIGS. 5A and 5B, a peripheral portion of the opening 114*a* is bent or expanded outward as is indicated by short arrows in FIG. 5B to form a cylindrical leading end 114*b* that is concentric with a major cylindrical portion of the member 114. Then, as is seen from FIG. 5C, the member 114 is subjected to a trimming process to remove an unnecessary part 110*b*. With this process, the flange 110 becomes shaped circular. Then, as is seen from FIG. 5D, one part 110*a* of the circular flange 110 is bent at right angles. Then, as is seen from FIG. 5E, the member 114 is subjected to an expansion process to provide the leading end thereof with an annular ridge 108. With this, the pipe member 106 is produced.

For assembling the tank 100, the following steps are taken.

First, the pipe member 106 is partially fixed or welded to the tank body 102, as is understood from FIG. 1. For this incomplete fixing, spot welding is applied to three portions P1, P2 and P3 of the unit of the tank body 102 and the pipe member 106, as is seen from FIGS. 2 and 3. If desired, for such incomplete fixing, other technique, such as caulking, laser beam welding or the like may be used. Then, this semi-finished tank 100 is incompletely mounted to a core structure to provide a so-called semi-finished radiator (not shown), and then the semi-finished radiator is applied with a non-corrosive flux and heated in a furnace. With this, production of the radiator is finished completing brazing of various parts thereof. The flange 110 is brazed to the tank body 102 in such a manner as has been described hereinabove.

In the above-mentioned first embodiment, the bent shape of the flange 110 of the pipe member 106 facilitates positioning and holding of the pipe member 106 to the tank body 102. That is, the right-angled arcuate part 110*a* of the flange 110 can be used as a suspending means for suspending the pipe member 106 on the tank body 102, as will be seen from FIG. 1. Since the uppermost end of the circular opening 104 of the side wall 102*b* is mated with the inner surface of the upper wall 102*c* of the tank body 102, the height needed by the tank body 102 for connecting with the pipe member 106 is reduced, which brings about a compact construction of the tank 100 and the associated radiator.

Figure 6:
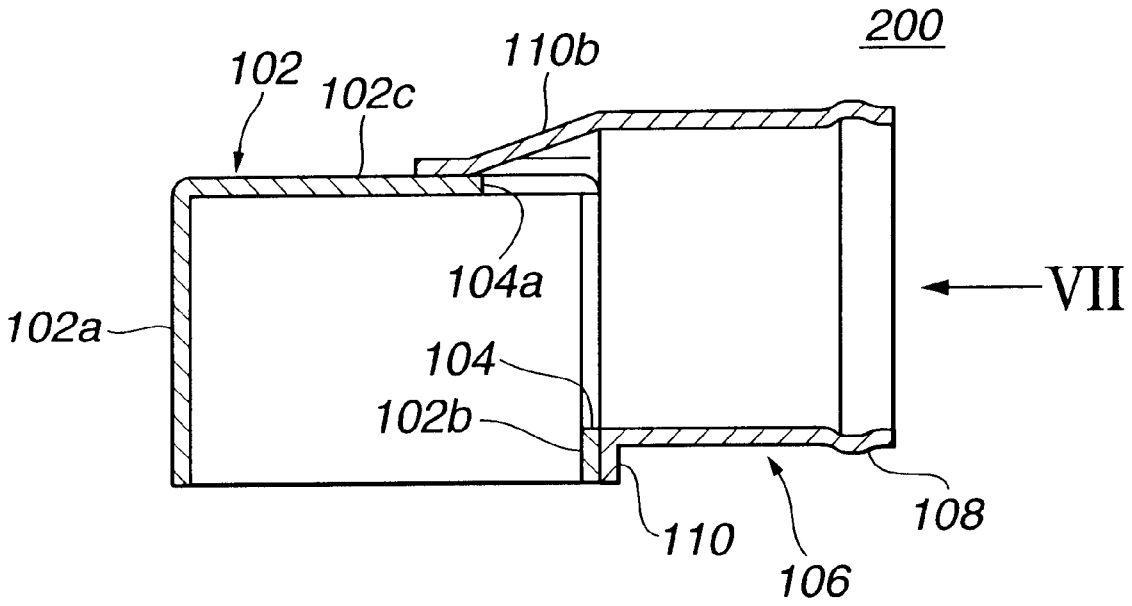
FIG. 6 is a sectional view of a tank of heat exchanger, which is a second embodiment of the present invention.
Figure 7:
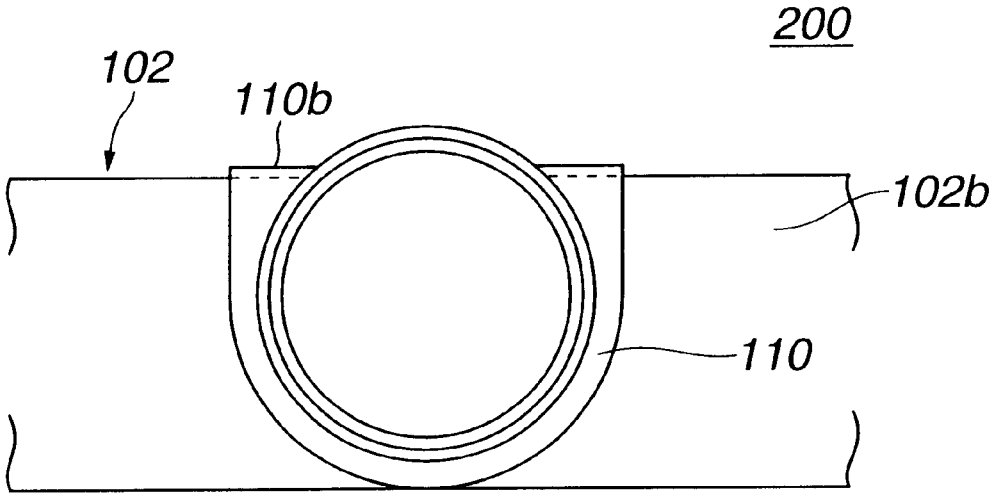
FIG. 7 is a front view of the tank of the second embodiment, that is taken from a direction of the arrow "VII" of FIG. 6.
Figure 8:
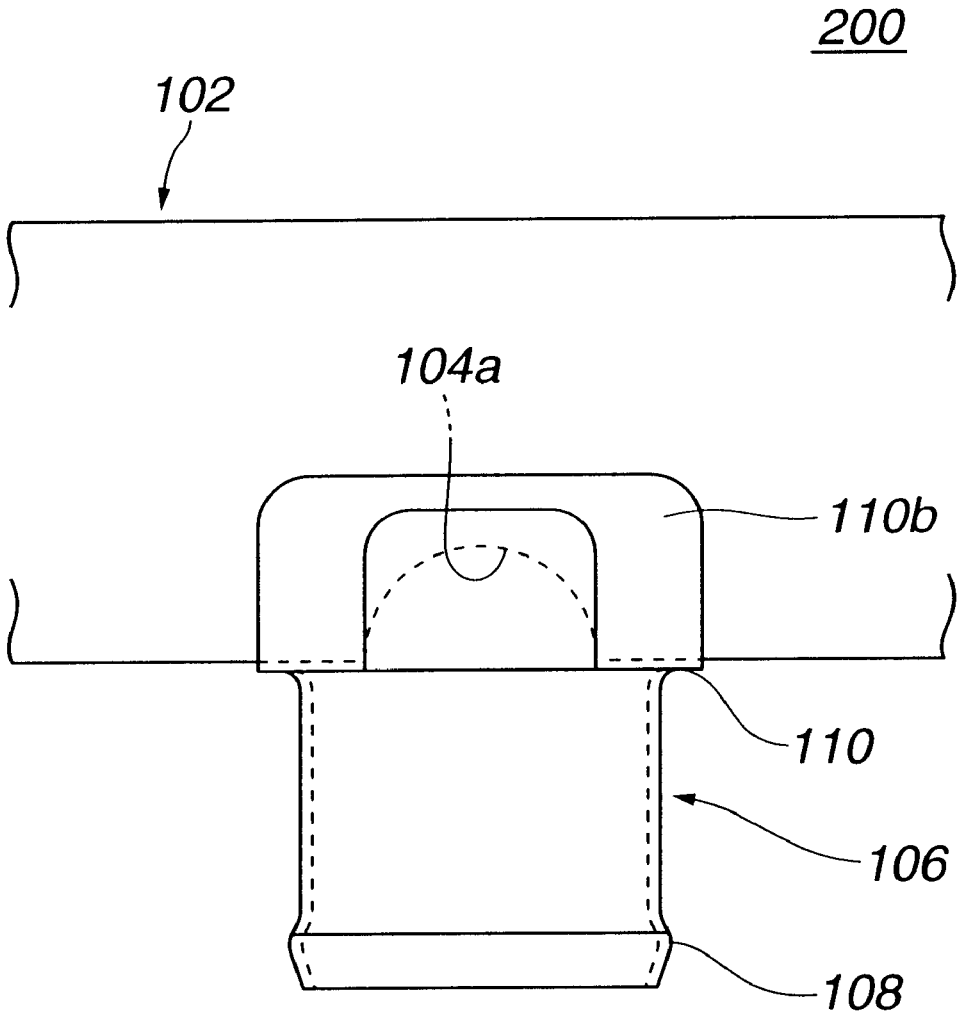
FIG. 8 is a plan view of the tank of the second embodiment.

Referring to FIGS. 6 to 8, there is shown a tank 200 of heat exchanger, which is a second embodiment of the present invention.

Since the tank 200 of this embodiment is similar to that 100 of the above-mentioned first embodiment, only parts and structures which are different from those of the first embodiment 100 will be described in the following.

In this second embodiment 200, the circular opening 104 extends to the upper wall 102*c* of the tank body 102. That is, the opening 104 comprises a generally circular major part formed in the side wall 102*b* and an arcuate part 104*b* formed in the upper wall 102*c*. For surrounding both the generally circular major part and the arcuate part 104*b* of the opening 104, the flange 110 of the pipe member 106 comprises a generally circular major part which is brazed to a peripheral portion of the generally circular opening part of the side wall 102*b* and a generally rectangular part 110*b* (see FIG. 8) which is brazed to a peripheral portion of the arcuate opening part 104*a* of the upper wall 102*c*. As is seen from FIG. 6, for assuring a fluid communication between the arcuate opening part 104*a* and the interior of the pipe member 106, the rectangular part 110*b* of the flange 110 is somewhat raised from the upper wall 102*c* of the tank body 102. In the illustrated embodiment, the rectangular part 110*b* is swelled and sloped relative to the upper wall 102*c*.

In addition to the advantages possessed by the above-mentioned first embodiment 100, the second embodiment 200 has such an advantaged that the height needed by the tank body 102 for connecting with the pipe member 106 is much reduced, which brings about much compact construction of the tank 200.

Figure 9:
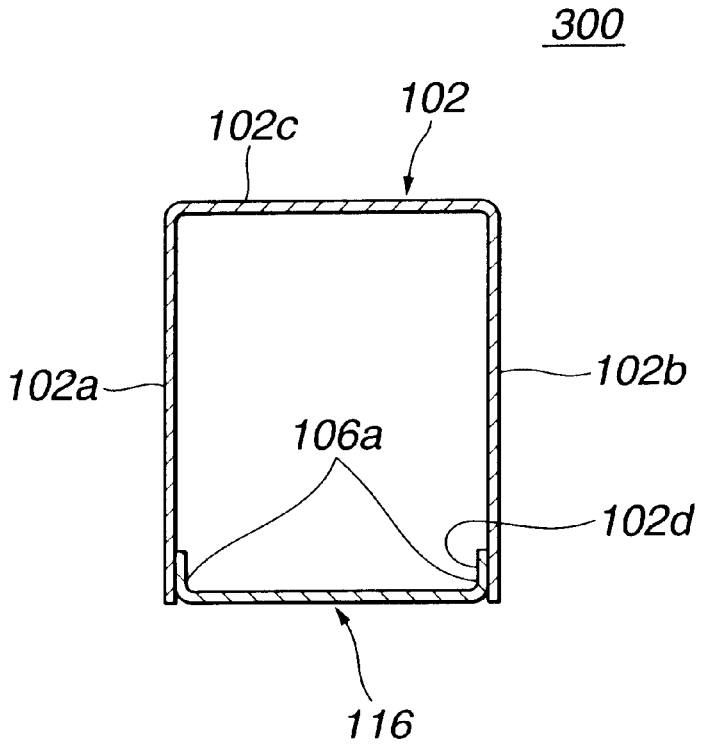
FIG. 9 is a sectional view of a tank of heat exchanger, which is a third embodiment of the present invention.
Figure 10:
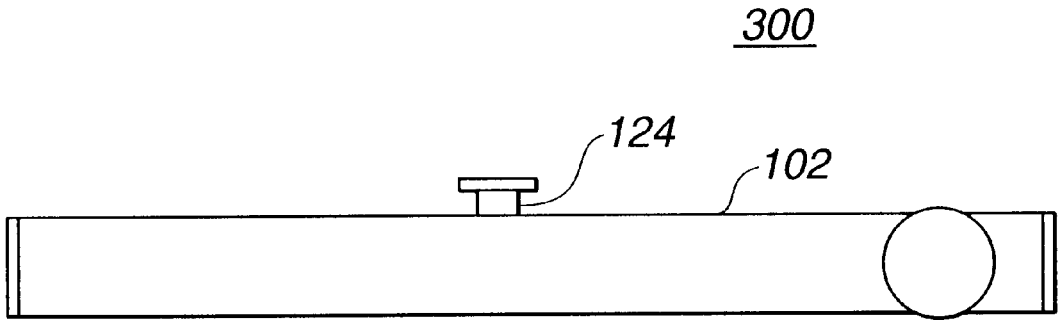
FIG. 10 is a side view of the tank of the third embodiment.

Referring to FIGS. 9 to 17, particularly FIGS. 9 and 10, there is shown a tank 300 of heat exchanger, which is a third embodiment of the present invention.

The tank 300 of this third embodiment comprises a tank body 102 made of a clad metal, such as a clad aluminum plate or the like. The tank body 102 is shaped like a channel member including opposed side walls 102*a* and 102*b* and an upper wall 102*c*. The tank body 102 has a lower portion 102*d* fully opened as shown in FIG. 1. An inner surface of the tank body 102 is coated with a corrosion resisting material or self-sacrificing corrosion material, and an outer surface of the tank body 102 is lined with a brazing metal.

An elongate header plate member 116 is fitted in the lower portion 102*d* of the tank body 102. The header plate member 116 is formed along side edges thereof with respective flanges 116*a* which are brazed to lower ends of the respective side walls 102*a* and 102*b* of the tank body 102. An inner surface of the header plate member 116 is coated with a corrosion resisting material or self-sacrificing corrosion material, and an outer surface of the header plate member 116 is lined with a brazing metal.

Figure 11:
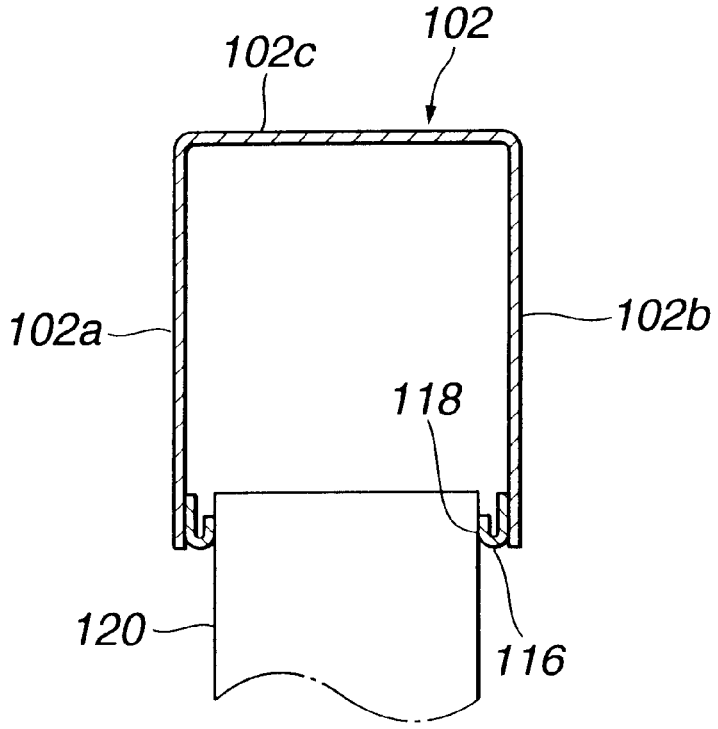
FIG. 11 is a sectional view of the tank of the third embodiment, showing a header plate member fitted in a longitudinally extending opening of a tank body.
Figure 12:
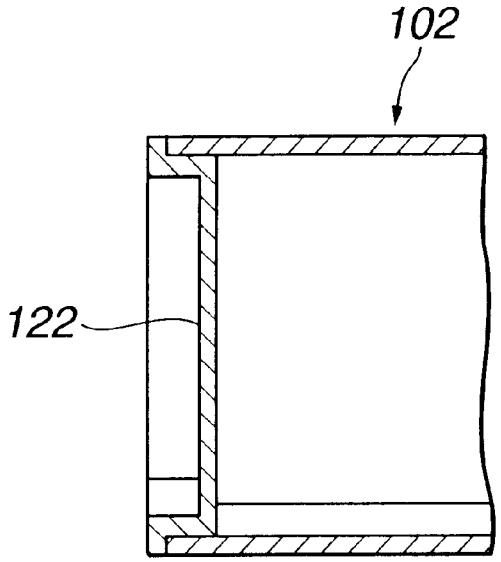
FIG. 12 is a front view of the tank of the third embodiment, showing an end plate fixed to a longitudinal end of the tank body.
Figure 13:
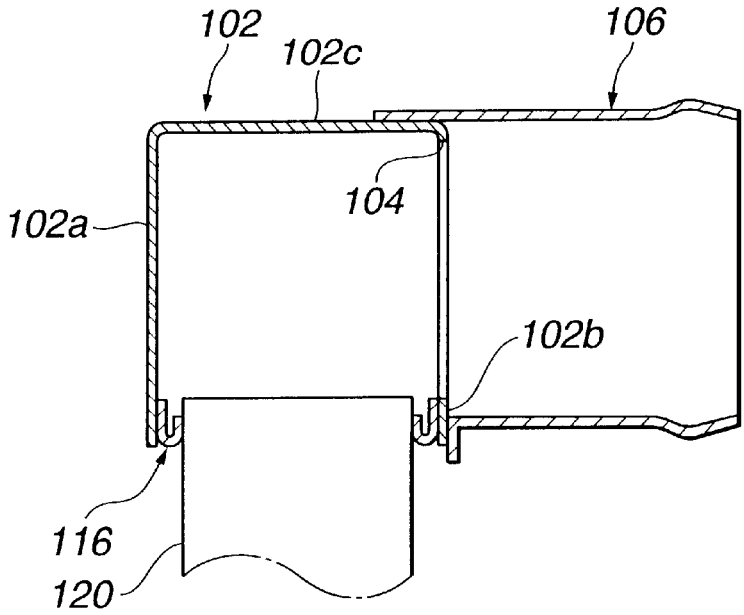
FIG. 13 is a sectional view of the tank of the third embodiment, showing the header plate member and a pipe member which are fixed to the tank body.

As is understood from FIG. 11, the elongate header plate member 116 is formed with a plurality of slits 118 which are arranged at equally spaced intervals along the length thereof. The slits 118 receive therein one ends of flat tubes 120 which constitute a core structure of the radiator (not shown). As is seen from FIG. 12, end plates 122 are fixed via brazing to longitudinal ends of the tank body 102. Furthermore, as is seen from FIG. 13, a pipe member 106 is connected to the tank body 102 in a manner to establish a fluid communication with the tank body 102 through an opening 104 formed in the side wall 102*b* of the tank body 102.

Figure 14:
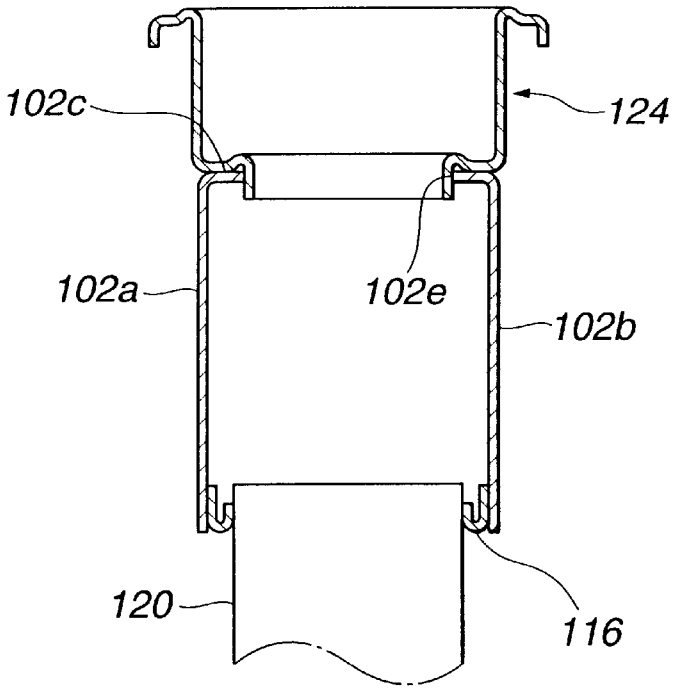
FIG. 14 is a sectional view of the tank of the third embodiment, showing a portion where a filler-neck is arranged.

As is seen from FIG. 14, a filler neck member 124 is connected to the upper wall 102*c* of the tank body 102 in a manner to provide a fluid communication with the tank body 102 through an opening 102*e* formed in the upper wall 102*c*.

Figure 15A:
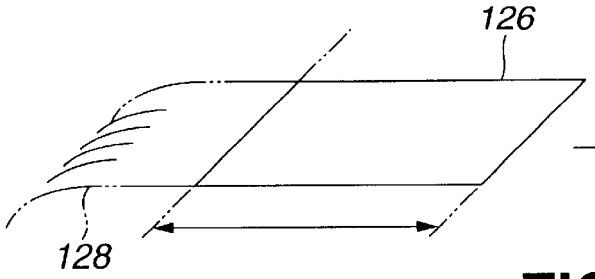
FIGS. 15A, 15B and 15C are views showing steps for producing the tank body used in the third embodiment.
Figure 15B:
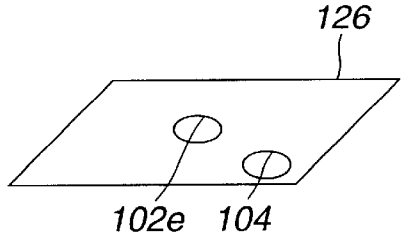
Figure 15C:
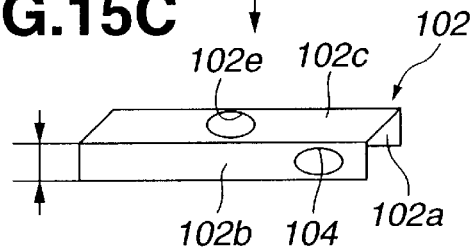

For producing the tank body 102, as is seen from FIG. 15A, a rectangular plate 126 is cut out from a coiled plate block 128. Then, as is seen from FIG. 15B, an opening 102*e* for the filler neck 124 and an opening 104 for the pipe member 106 are formed in the plate 126. Then, as is seen from FIG. 15C, the plate 126 is pressed to have a substantially channel structure. With this, the tank body 102 is produced.

Figure 16A:
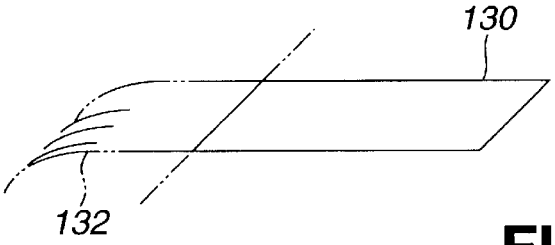
FIGS. 16A, 16B and 16C are views showing steps for producing the header plate member used in the third embodiment.
Figure 16B:
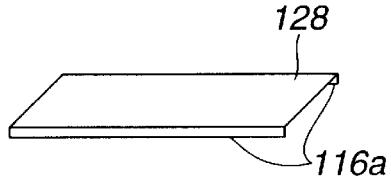
Figure 16C:
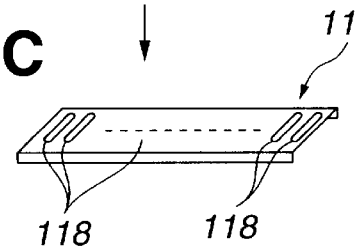
Figure 17:
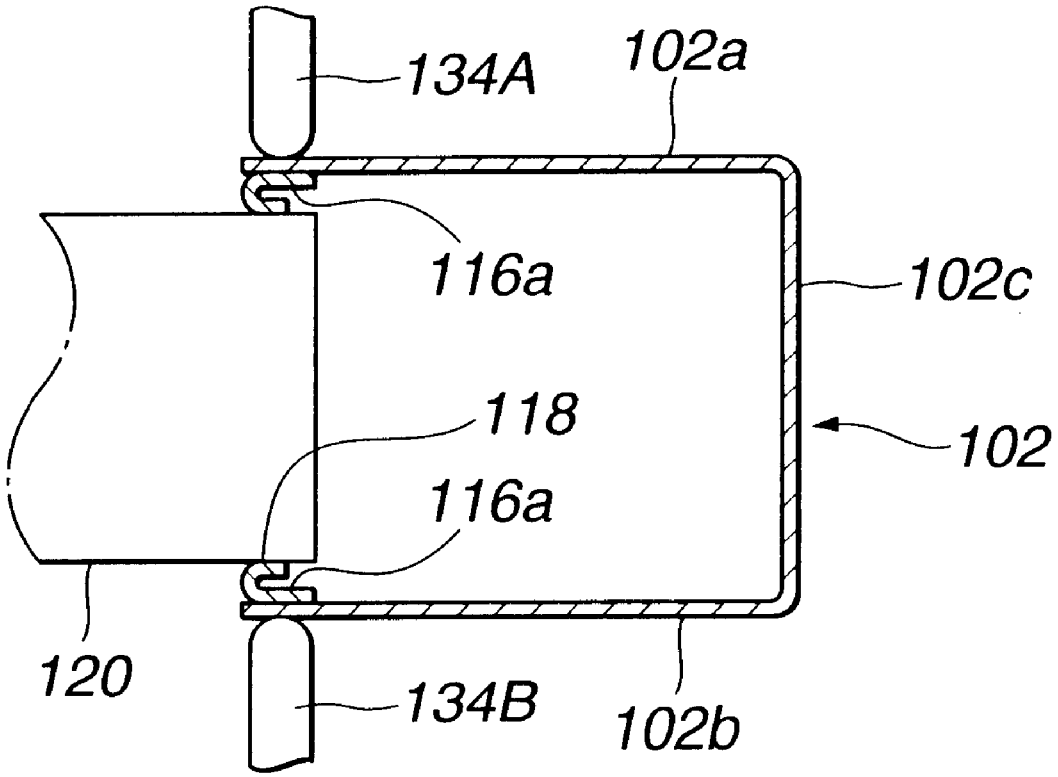
FIG. 17 is a sectional view of the tank of the third embodiment, showing a method for partially welding the header plate member to the tank body.

For producing the header plate member 116, as is seen from FIG. 16A, an elongate plate 130 is cut out from a coiled plate block 132. Then, as is seen from FIG. 16B, the plate 130 is pressed to have two flanges 116*a* along both sides thereof. Then, as is seen from FIG. 16C, the plate 130 is subjected to a punching process to have a plurality of slits 118, and then subjected to a finishing process. With this, the header plate member 116 is produced.

For assembling the tank 300, the following steps are taken.

First, the pipe member 106 and the filler neck 124 are partially welded to the tank body 102. Two header plate members 116 are arranged keeping a given space therebetween. A plurality of flat tubes 120 and a plurality of corrugated fins (not shown) are put between the two header plate members 116. In this case, opposed ends of each flat tube 120 are snugly inserted in respective slits 118 of the header plate members 116. Then, to each header plate member 116, there is partially or incompletely connected a corresponding tank body 102 in such a manner as is understood from FIG. 17. For this incomplete coupling, as is seen from this drawings, spot welding is employed, contacting the tapered electrodes 134A and 134B onto the left (or lower) ends of the side walls 102*a* and 102*b*. With this, each flange 116*a* of the header plate member 116 and the corresponding end of the side wall 102*a* or 102*b* are incompletely fixed. Of course, the tank body 102 is connected to one terminal of the spot welding device. Since the electric resistance of the tank body 102 is sufficiently high than that of the header plate member 116, such spot welding can be made without using an inner electrode. Preferably, the spot welding is carried out under a condition wherein the pressing force applied by the electrodes 134A and 134B is about 10 to 30 Kgf and the current applied to the electrodes is about 7,000 to 10,000 A. Then, the end plates 122 are partially or incompitely fixed to the ends of the tank body 102. With this, a so-called semi-finished radiator is provided. Then, the semi-finished radiator is applied with a non-corrosive flux and heated in a furnace. With this, production of the radiator is finished completing brazing of various parts thereof. That is, with this brazing process, the incompletely fixed portions of the radiator are completely fixed or brazed to each other.

In the above-mentioned third embodiment 300, usage of the spot welding for the partial or incomplete fixing between the header plate member 116 and the tank body 102 facilitates positioning and holding of the header plate member 116 to the tank body 102. Thus, a subsequent brazing process is smoothly and readily carried out, which brings about a cost reduction of the tank 300 and the associated radiator. In fact, the tank body 102 in this third embodiment 300 can be produced at a reduced cost as compared with the tank body 102 of the first embodiment 100. In the first embodiment 100, somewhat expensive deep drawing technique is used.

Figure 18:
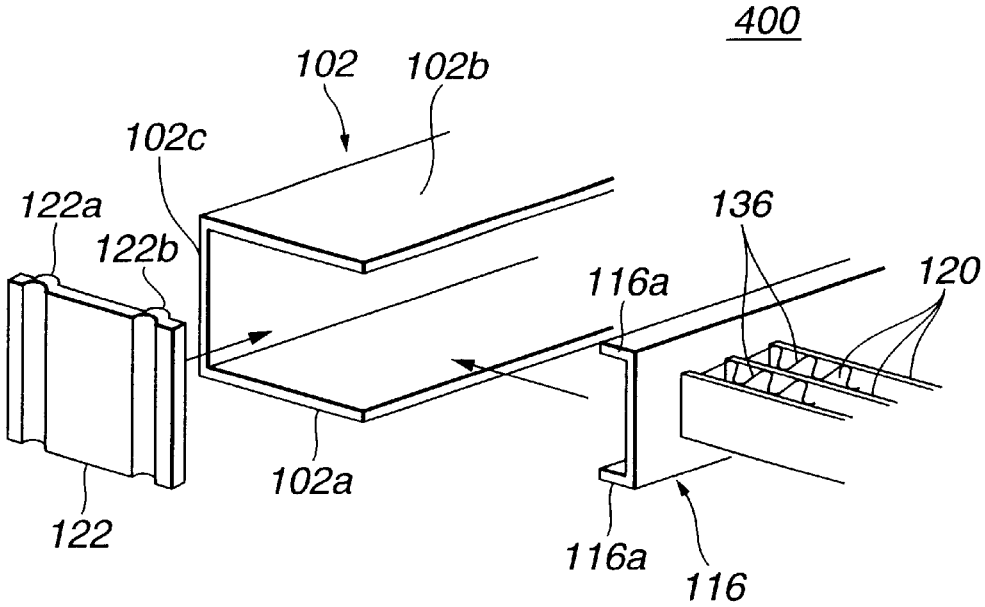
FIG. 18 is an exploded perspective view of a tank of heat exchanger, which is a fourth embodiment of the present invention.
Figure 19:
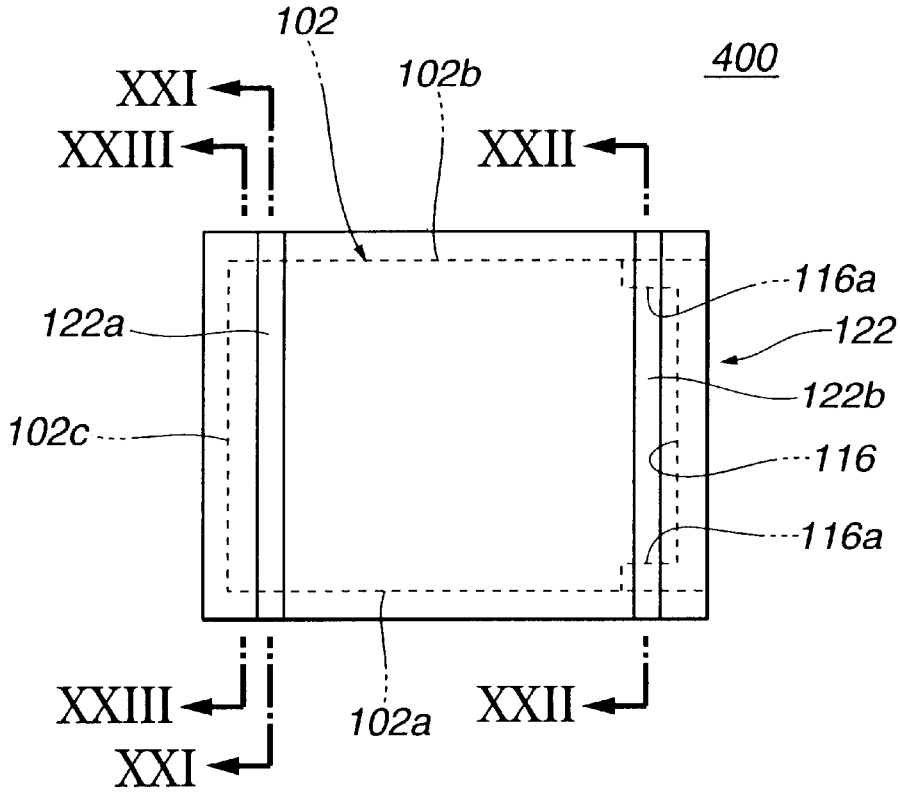
FIG. 19 is a side view of the tank of the fourth embodiment.

Referring to FIGS. 18 to 28, particularly FIGS. 18 and 19, there is shown a tank 400 of heat exchanger, which is a fourth embodiment of the present invention.

Since the tank 400 of this fourth embodiment is similar in construction to the tank 300 of the above-mentioned third embodiment, only portions and parts which are different from those of the third embodiment 300 will be described in detail in the following.

As is seen from FIG. 18, the tank 400 of this fourth embodiment comprises a tank body 102, a header plate member 116 and two end plates 122 (only one is shown), which are assembled in substantially the same manner as in the case of the third embodiment 300. That is, the header plate member 116 carrying the flat tubes 120 and the corrugated fins 136 is brazed to the open portion 102*d* of the tank body 102, and the two end plates 122 are brazed to the longitudinal ends of the tank body 102.

In the fourth embodiment 400, there is further employed the following measures.

That is, as is seen from FIG. 18, each end plate 122 is formed at an inner surface thereof with two ridges 122*a* and 122*b* which extend in parallel. These two ridges 122*a* and 122*b* are formed by subjecting the end plate 122 a press working. These ridges 122*a* and 122*b* are used for partially or incompletely fixing the end plate 122 to the tank body 102 before effecting the brazing process, as will become apparent as the description proceeds. That is, for carrying out a so-called projection welding, such ridges 122*a* and 122*b* are used.

As is seen from FIG. 19, upon a semi-finished assembly provided by the projection welding, the ridge 122*a* extends between ends of the side walls 102*a* and 102*b* of the tank body 102, and the other ridge 122*b* extends between the ends of the flanges 116*a* of the header plate member 116 as well as between the ends of the side walls 102*a* and 102*b* of the tank body 102. The end plate 122 is then brazed to the ends of the tank body 102 and the header plate member 116.

For assembling the tank 400, the following steps are taken.

Figure 20:
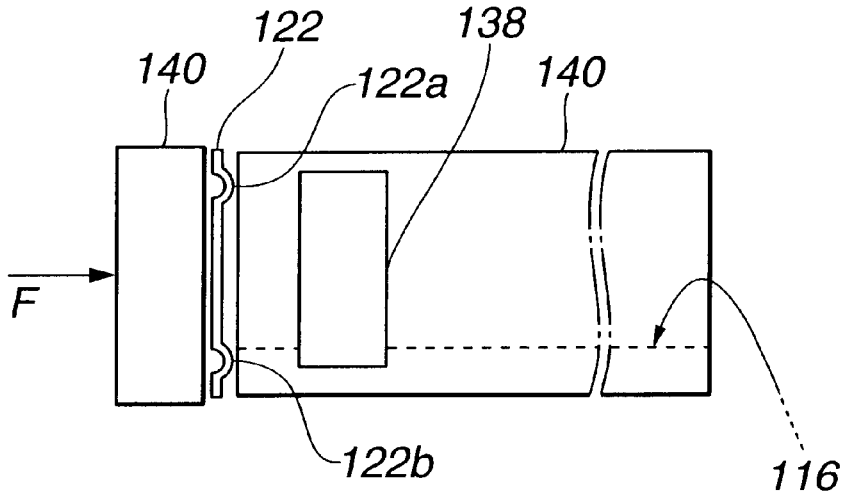
FIG. 20 is an illustration showing a method for partially welding an end plate to a longitudinal end of a unit including a tank body and a header plate member.
Figure 21:
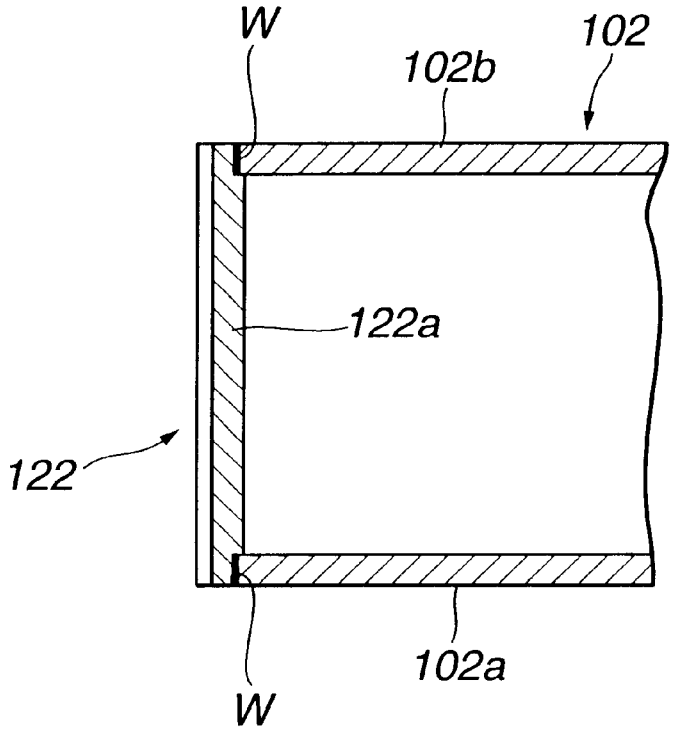
FIG. 21 is a sectional view taken along the line XXI—XXI of FIG. 19.
Figure 22:
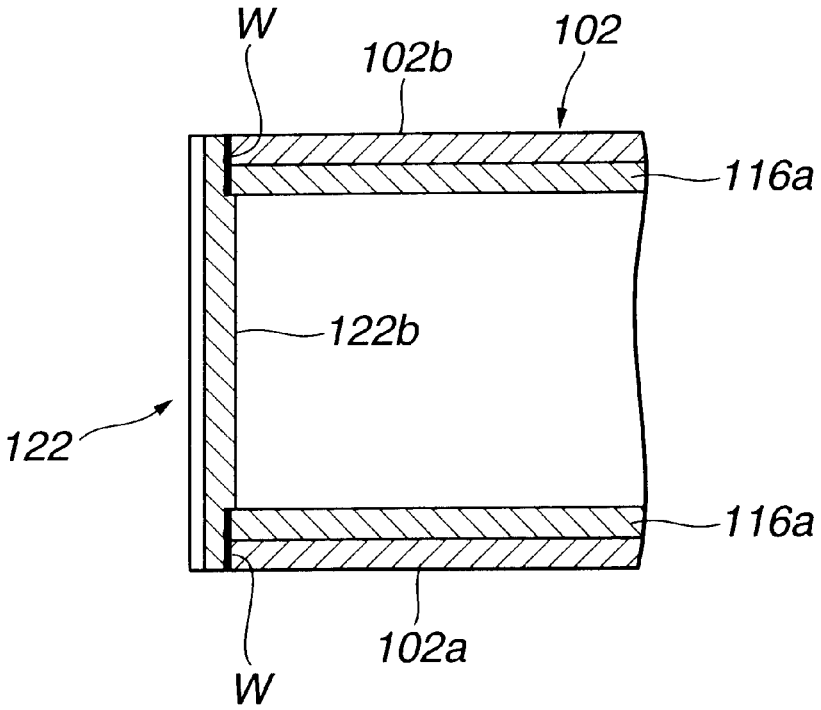
FIG. 22 is a sectional view taken along the line XXII—XXII of FIG. 19.
Figure 23:
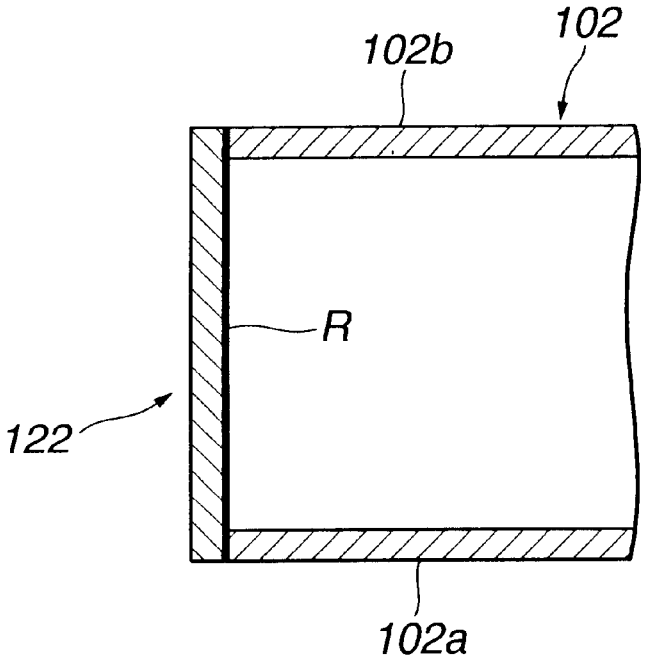
FIG. 23 is a sectional view taken along the line XXIII—XXIII of FIG. 19.
Figure 24:
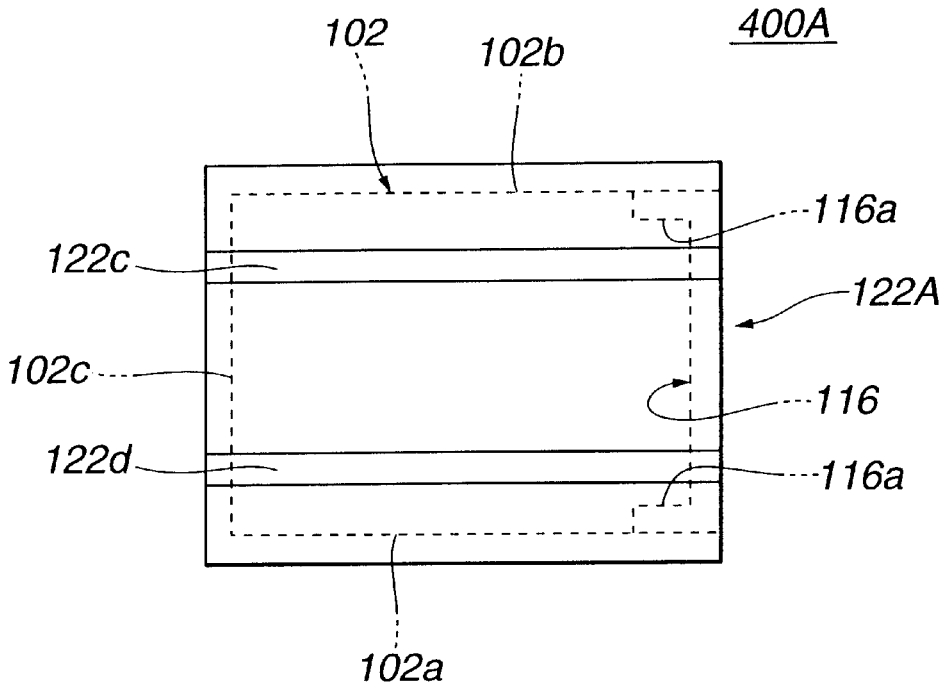
FIG. 24 is a view showing a first modification of the fourth embodiment.
Figure 25:
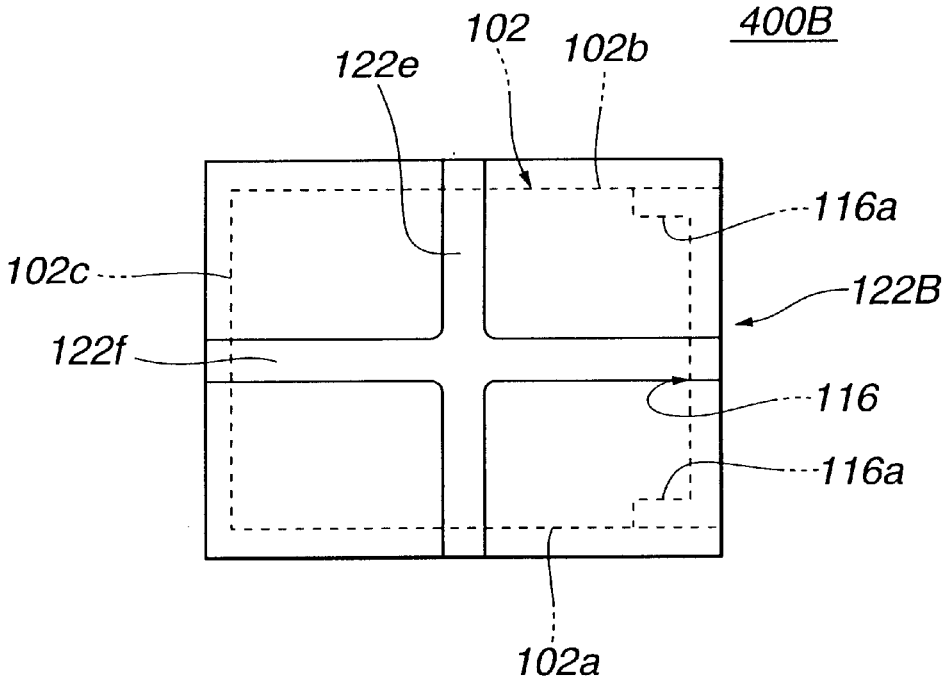
FIG. 25 is a view showing a second modification of the fourth embodiment.
Figure 26:
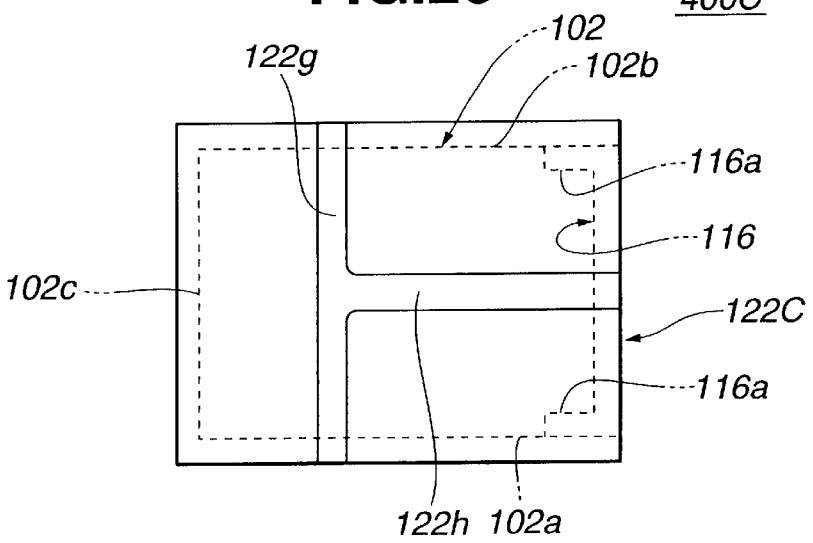
FIG. 26 is a view showing a third modification of the fourth embodiment.
Figure 27:
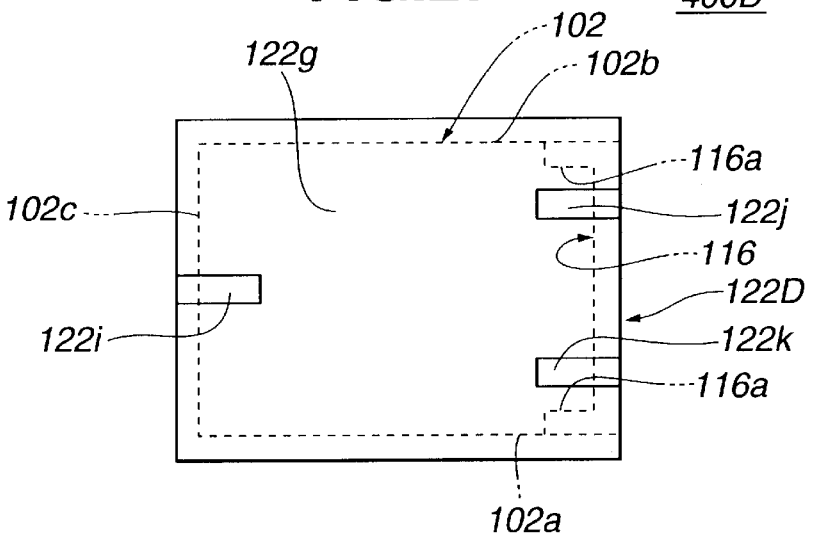
FIG. 27 is a view showing a fourth modification of the fourth embodiment.

As is seen from FIG. 20, the header plate member 116 carrying the flat tubes 120 (see FIG. 18) and corrugated fins 136 is put into a given position of the tank body 102. Then, each end plate 122 is partially or incompletely fixed to the corresponding ends of the tank body 120 and the header plate member 116 through the projection welding. For this projection welding, two first flat electrodes 138 are attached to the respective side walls 102*a* and 102*b* of the tank body 102, and a second flat electrode 140 is handled to press the end plate 122 by a certain force "F" against the ends of the tank body 102 and the header plate member 116, and a certain voltage is applied between the first and second electrodes 138 and 140. With this, the ridges 122*a* and 122*b* are welded to the ends of the tank body 102 and the header plate member 116. That is, as is seen from FIGS. 21 and 22, longitudinal ends of each ridge 122*a* or 122*b* are well welded at positions "W" to the corresponding ends of the tank body 102 and the header plate member 116. With this welding, each end plate 122 is partially or incompletely fixed to the ends having other portions intimately contacting with the same. With this, a so-called semi-finished radiator is provided. Then, the semi-finished radiator is applied with a non-corrosive flux and put into a furnace to be subjected to a brazing process. With this, production of the radiator is finished completing brazing of various parts thereof. That is, as is seen from FIG. 23, with this brazing process, the incompletely fixed portions of the radiator become completely fixed or brazed to each other. That is, by the heat generated in the furnace, the brazing metal "R" lined on the inner surface of the end plate 122, the header plate member 116 and the tank body 102 is fused for carrying out brazing therebetween. During this, the flat tubes 120 (see FIG. 18), the corrugated fins 136 and the corresponding header plate member 116 achieve the mutual brazing therebetween.

Figure 44:
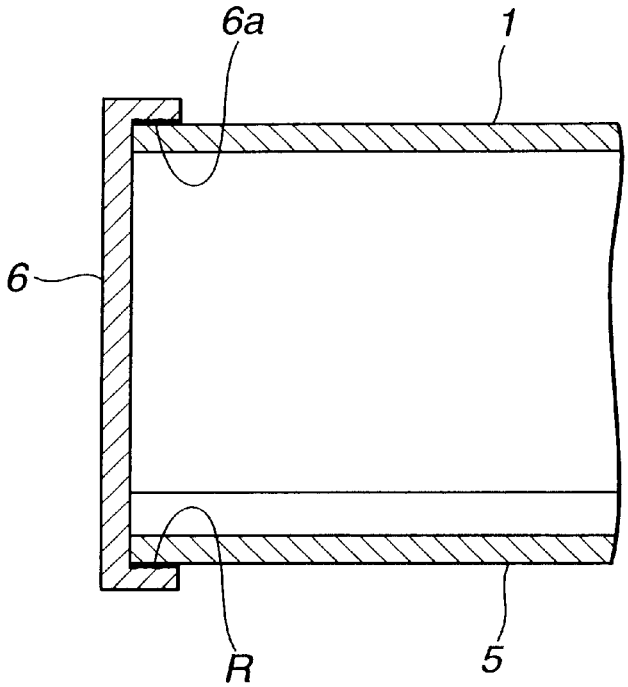
FIG.44 (PRIOR ART)
FIG. 44 is a sectional view of a fourth conventional tank of heat exchanger.
Figure 45:
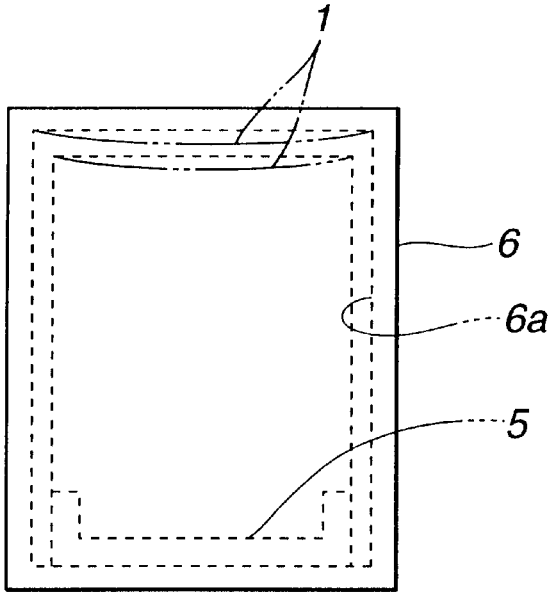
FIG.45 (PRIOR ART)
FIG. 45 is a side view of the fourth conventional tank of heat exchanger, showing a condition wherein a tank body is deformed.
Figure 46:
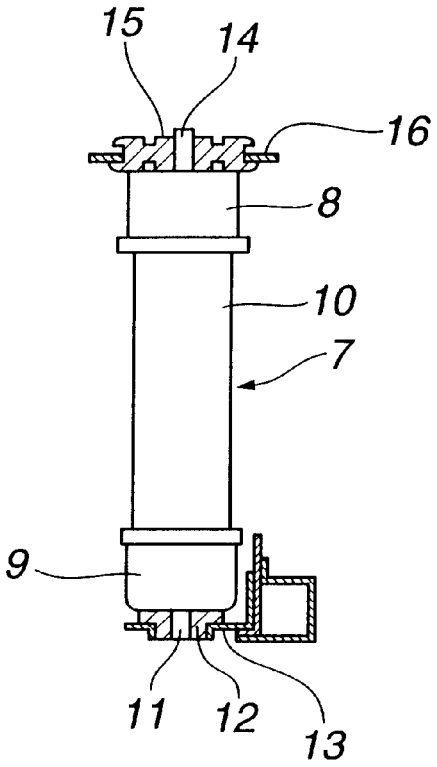
FIG.46 (PRIOR ART)
FIG. 46 is a sectional view of a radiator mounted to a motor vehicle through a conventional holding structure.
Figure 47:
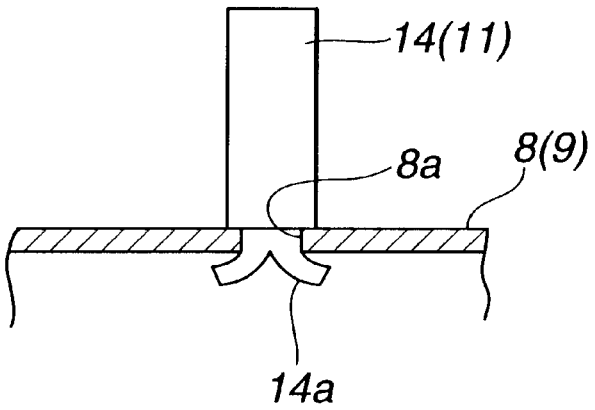
FIG.47 (PRIOR ART)
FIG. 47 is a view showing a conventional manner for partially welding a mounting pin to a tank body.

In the above-mentioned fourth embodiment 400, usage of the projection welding for the partial or incomplete fixing between the end plate 122, the tank body 102 and the header plate member 116 facilitates the mutual positioning therebetween and thus facilitates and assures the subsequent brazing process applied thereto. That is, in this fourth embodiment, brazing failure such as one depicted by FIG. 44 is assuredly suppressed. Since the ridges 122*a* and 122*b* formed on each end plate 122 need only a low dimensional precision, the end plates 122 can be produced at a lower cost.

FIGS. 24, 25, 26 and 27 show first, second, third and fourth modifications 400A, 400B, 400C and 400D of the tank 400 of the fourth embodiment. In the first modification 400A of FIG. 24, the end plate 122A is so oriented that each of ridges 122*c* and 122*d* extends between the end of the upper wall 102*a* of the tank body 102 and the end of the header plate member 116. In the second modification 400B of FIG. 25, the two ridges 122*e* and 122*f* on the end plate 122B are arranged to cross, and the end plate 122B is so oriented that the ridge 122*e* extends between the ends of the side walls 102*a* and 102*b* of the tank body 102 and the other ridge 122*f* extends between the end of the upper wall 102*c* of the tank body 102 and the end of the header plate member 116, as shown. In the third modification 400C of FIG. 26, T-shaped ridge including a first part 122*g* and a second part 122*h* is formed on the end plate 122C, and the end plate C 122 is so oriented that the first part 122*g* extends between the ends of the side walls 102*a* and 102*b* of the tank body 102 and the second part 122*h* extends from the first part 122*g* to the end of the header plate member 116. In the fourth embodiment 400D of FIG. 27, three separate ridges 122*i*, 122*j* and 122*k* are formed on the end plate 122D, and the end plate 122D is so oriented that the ridge 122*i* extends to the end of the upper wall 102*c* of the tank body 102, the ridges 122*j* and 122*k* extend to the end of the header plate member 116, as shown.

For assembling the tanks 400 and 400A to 400D, the following steps may be also taken.

Figure 28:
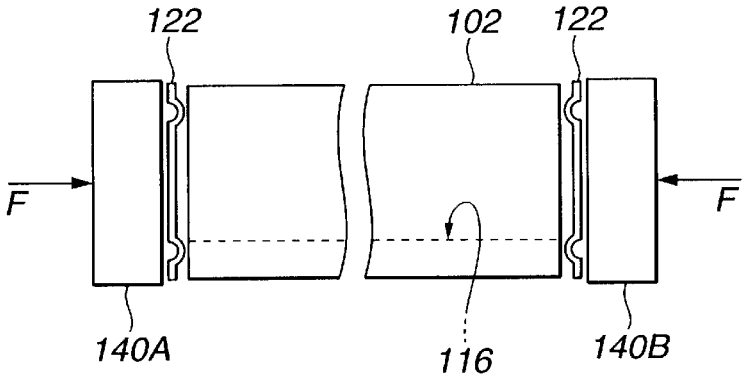
FIG. 28 is an illustration showing a method for partially welding two end plates to longitudinal both ends of a unit including a tank body and a header plate member.

That is, as is seen from FIG. 28, two flat electrodes 140A and 140B are used, which are handled to press the corresponding end plates 122 by a certain force "F" against the ends of the tank body 102 and the header plate member 116, and a certain voltage is applied between the two flat electrodes 140A and 140B.

Figure 29:
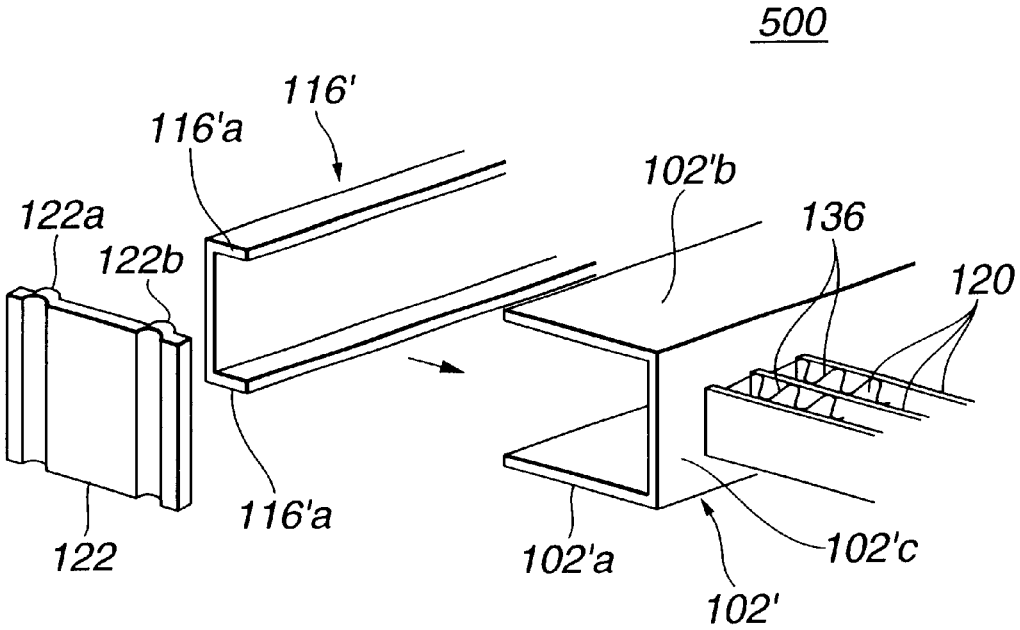
FIG. 29 is an exploded perspective view of a tank of heat exchanger, which is a fifth embodiment of the present invention.
Figure 30:
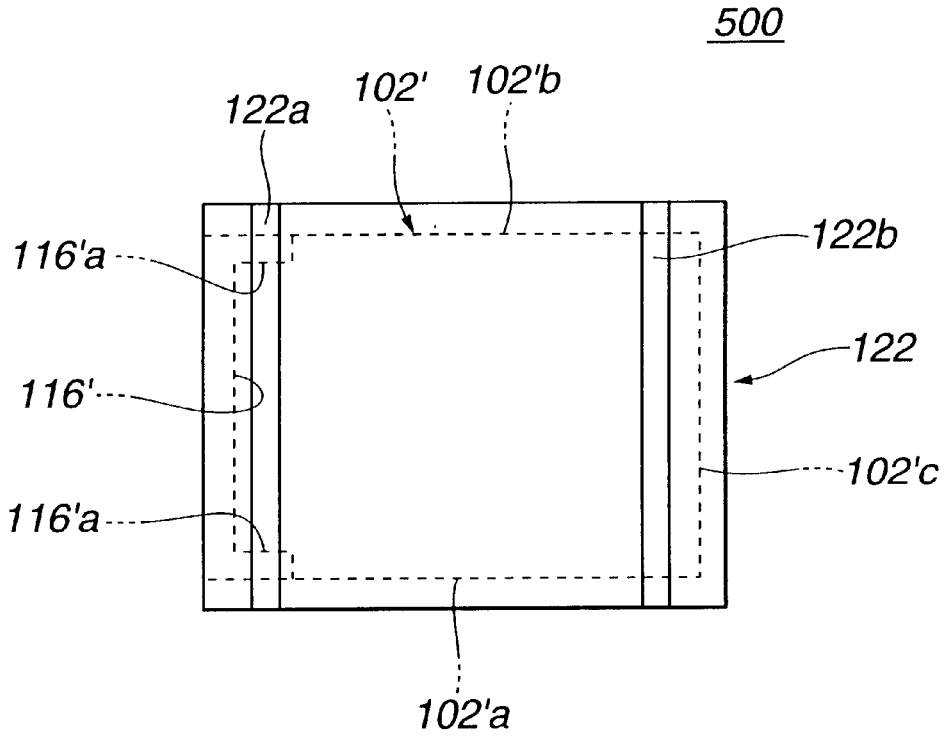
FIG. 30 is a side view of the tank of the fifth embodiment.

Referring to FIGS. 29 and 30, there is shown a tank 500 of heat exchanger, which is a fifth embodiment of the present invention.

As is seen from FIG. 29, in the tank 500 of this fifth embodiment, the flat tubes 120 and the corrugated fins 136 are connected to a tank body 102'. For covering the open portion of the tank body 102, an elongate cover plate 116' is employed. End plates 122 with ridges 122*a* and 122*b* are partially or incompletely fixed to ends of the tank body 102' and the cover plate 116' through projection welding and then tightly secured to the same through brazing, like in the case of the above-mentioned fourth embodiment 400. As shown in FIG. 30, in the fifth embodiment 500, one ridge 122*a* of the end plate 122 extends between the ends of the flanges 116'*a* of the cover plate 116' as well as between the ends of the side walls 102'*a* and 102'*b* of the tank body 102', and the other ridge 122*b* of the end plate 122 extends between the ends of the side walls 102'*a* and 102'*b* of the tank body 102', as shown.

Figure 31:
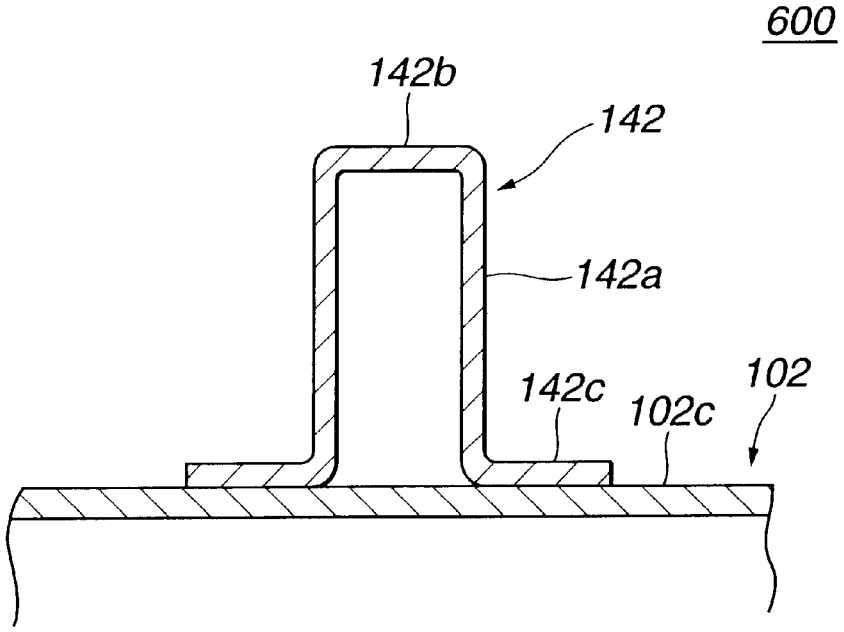
FIG. 31 is a partial sectional view of a tank of heat exchanger, which is a sixth embodiment of the present invention.
Figure 32:
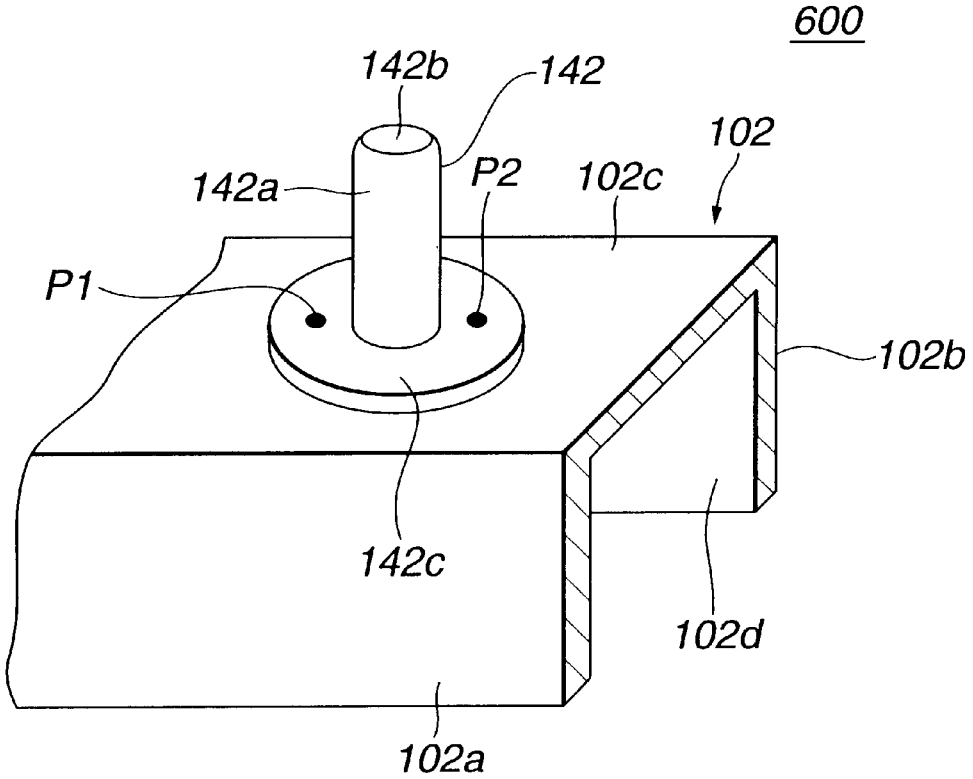
FIG. 32 is a partially cut perspective view of the tank of the sixth embodiment.
Figure 33A:
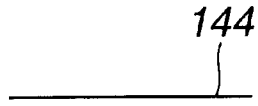
FIGS. 33A to 33E are illustrations explaining a method of producing a mounting pin used in the sixth embodiment.
Figure 33B:
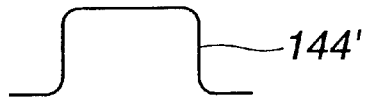
Figure 33C:
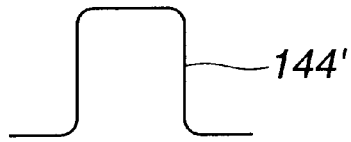
Figure 33D:
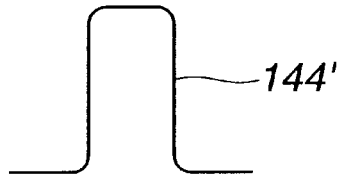
Figure 33E:
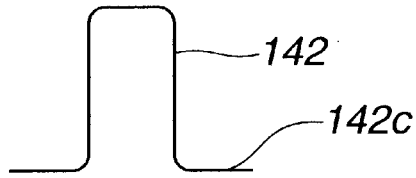
Figure 34:
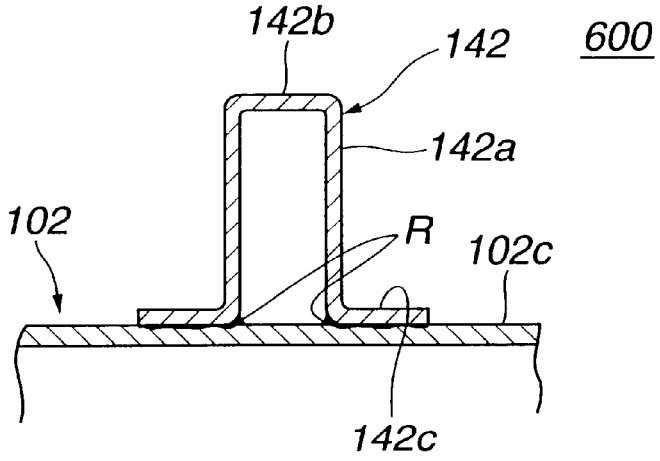
FIG. 34 is a sectional view of the tank of the sixth embodiment, showing a portion where brazing is practically applied.
Figure 35:
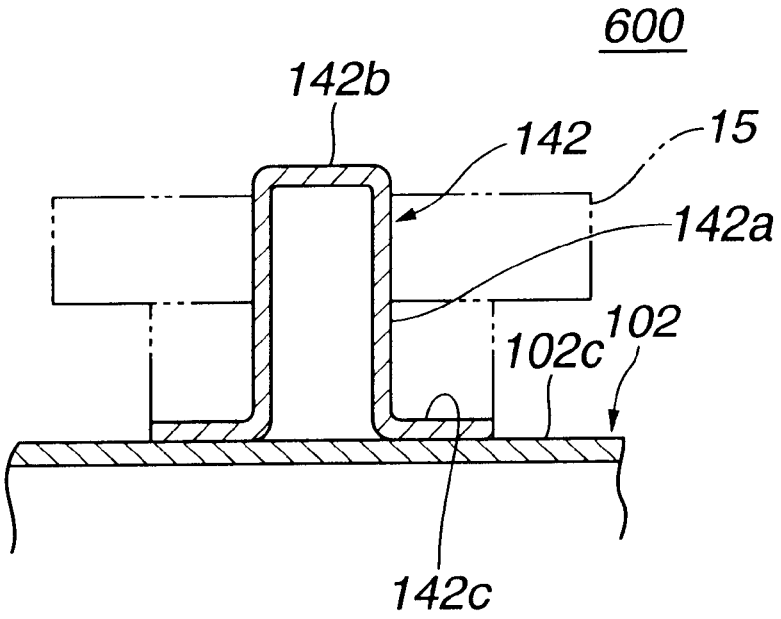
FIG. 35 is a sectional view of the tank of the sixth embodiment, showing a mount rubber mounted on the tank body through the mounting pin.

Referring to FIGS. 31 to 35, particularly FIGS. 31 and 32, there is shown a tank 600 of heat exchanger, which is a sixth embodiment of the present invention.

The tank 600 of this sixth embodiment comprises a tank body 102 made of a clad metal, such as a clad aluminum plate or the like. The tank body 102 is shaped like a channel member including opposed side walls 102*a* and 102*b* and an upper wall 102*c*. As shown in FIG. 32, the tank body 102 has a lower portion 102*d* fully opened. An inner surface of the tank body 102 is coated with a corrosion resisting material of self-sacrificing corrosion material, and an outer surface of the tank body 102 is lined with a brazing metal.

On the upper wall 102*c* of the tank body 102, there are mounted mounting pins 142 (only one is shown). These pins 142 are used for stably mounting a mount rubber 15 (see FIG. 35) on the tank body 102. Each pin 142 is a cylindrical hollow member made of a clad metal, such as a clad aluminum plate or the like. An outer surface of the pin 142 is coated with a corrosion resisting material or self-sacrificing corrosion material. The pin 142 comprises a cylindrical middle part 142*a*, a head part 142*b* and a circular flange part 142*c*, as shown. The flange part 142*c* is brazed to the upper wall 102*c* of the tank body 102.

For producing the pins 142, as is seen from FIGS. 33A to 33E, a flat plate 144 is subjected to a deep drawing process. Preferably, the deep drawing process is carried out through three drawing steps which are respectively shown in FIGS. 33B, 33C and 33D. At a final step of FIG. 33E, the flange part 142*c* is trimmed.

For assembling the tank 600, the following steps are taken.

First, the pin 142 is put on the upper wall 102*c* of the tank body 102, as is seen from FIG. 31. Then, spot welding is applied to two portions "P1" and "P2" of the flange 142*c*, as is shown in FIG. 32. With this, the pin 142 is partially or incompletely fixed to the upper wall 102*c* of the tank body 102. Then, this semi-finished tank 600 is partially or incompletely mounted to a core structure to provide a so-called semi-finished radiator (not shown), and then, the semi-finished radiator is applied with a non-corrosive flux and heated in a furnace. With this, production of the radiator is finished completing brazing of various parts thereof. The flange 142*c* is brazed to the upper wall 102*c* of the tank body 102 in such a manner as has been described hereinabove.

Because the pin 142 is of a tubular structure, it has only a small heat capacity, which facilitates brazing of the pin 142 to the tank body 102. As is seen from FIG. 35, when a mount rubber 15 is operatively held by the pin 142, the flange 142*c* of the pin 142 can serve as a seat member.

Figure 36:
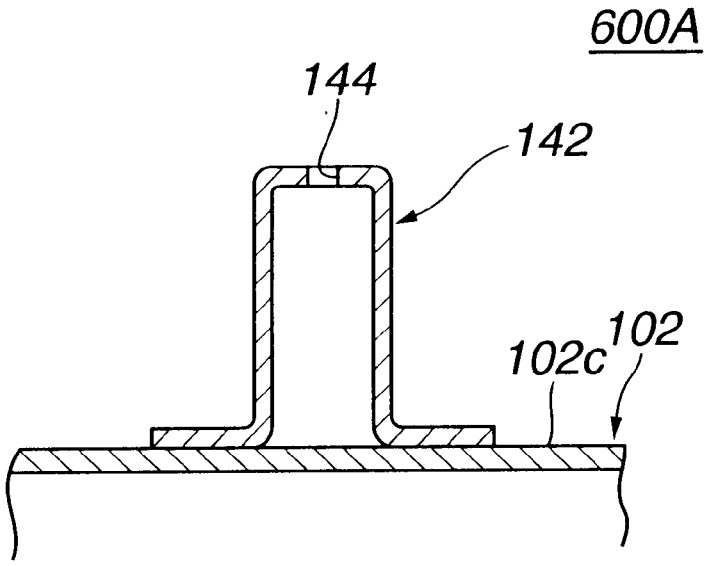
FIG. 36 is a view similar to FIG. 31, but showing a first modification of the sixth embodiment.
Figure 37:
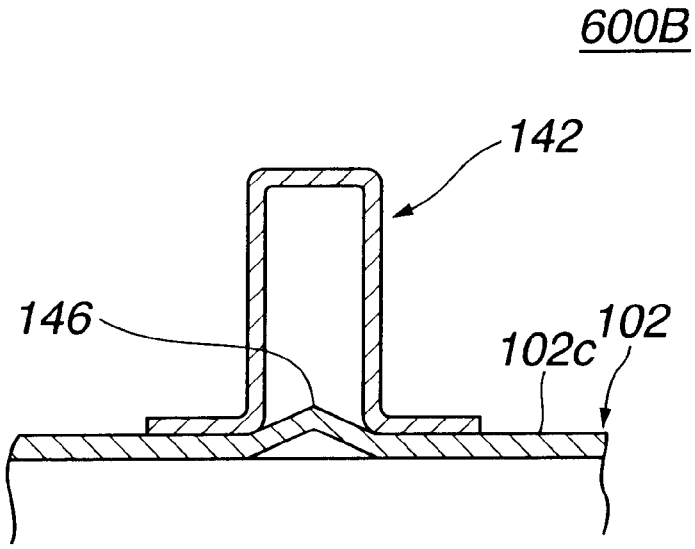
FIG. 37 is a view similar to FIG. 31, but showing a second modification of the sixth embodiment.
Figure 38:
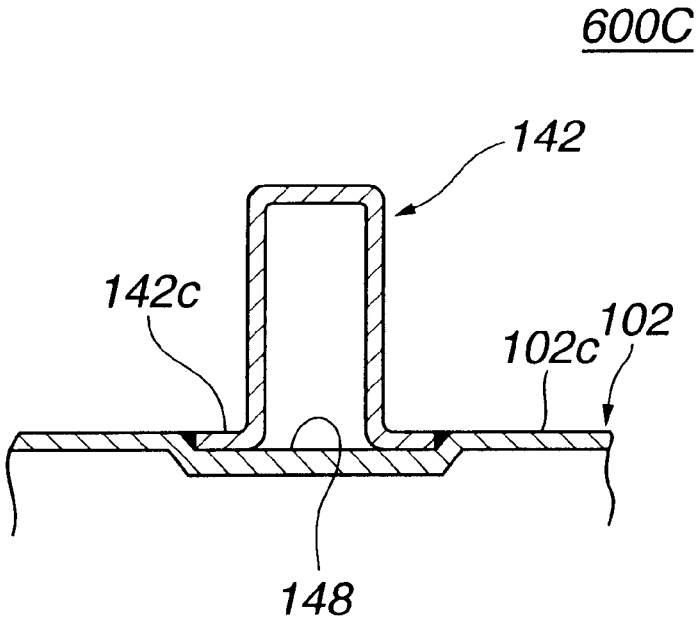
FIG. 38 is a view similar to FIG. 31, but showing a third modification of the sixth embodiment.

FIGS. 36, 37 and 38 show first, second and third modifications 600A, 600B and 600C of the tank 600 of the fifth embodiment. In the first modification 600A of FIG. 36, an opening 144 is formed in the head part 142*b* of the pin 142. Formation of such opening 144 facilitates the deep drawing process and washing of the pin 142. In the second modification 600B of FIG. 37, a projection 146 is formed on the upper wall 102*c* of the tank body 102 to facilitate positioning of the pin 142 relative to the tank body 102. In the third modification 600C of FIG. 38, a recess 148 is formed on the upper surface 102*c* of the tank body 102 to receive therein the flange 142*c* of the pin 142. With this, positioning and brazing of the pin 142 relative to the tank body 102 are facilitated.

Figure 39:
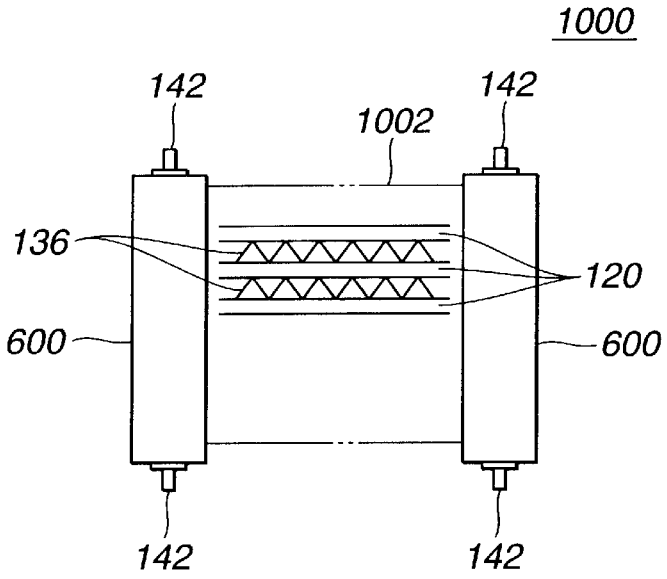
FIG. 39 is an illustration of a radiator having respective tanks at right and left sides.
Figure 40:
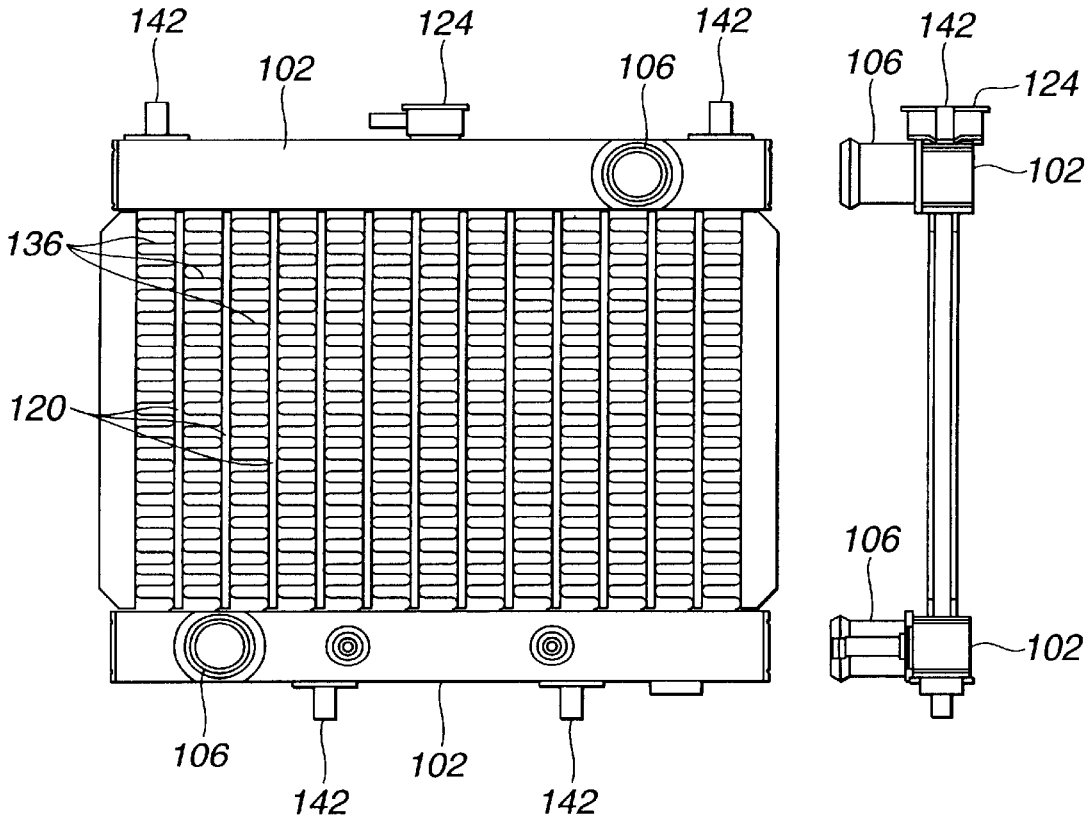
FIG. 40 is a schematic illustration of an automotive radiator to which tanks of the present invention are practically mounted.
Figure 41:
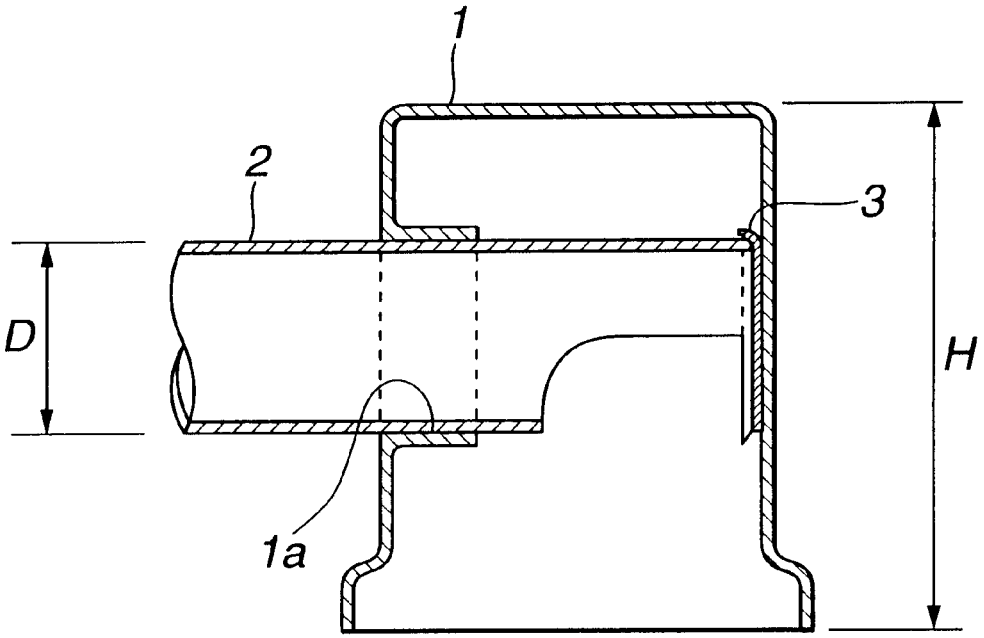
FIG.41 (PRIOR ART)
FIG. 41 is a sectional view of a first conventional tank of heat exchanger.
Figure 42:
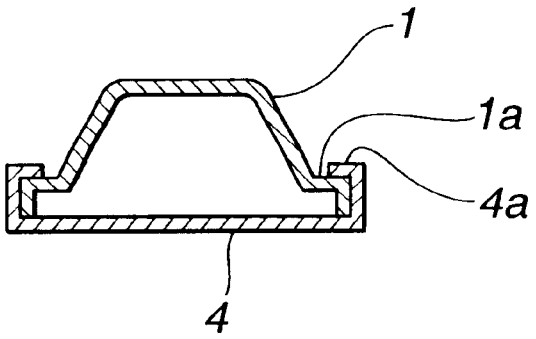
FIG.42 (PRIOR ART)
FIG. 42 is a sectional view of a second conventional tank of heat exchanger.
Figure 43:
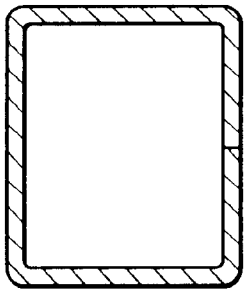
FIG.43 (PRIOR ART)
FIG. 43 is a sectional view of a third conventional tank of heat exchanger.

FIG. 39 shows a radiator 1000 to which two tanks 600 of the fifth embodiment are practically applied. The radiator 100 comprises a core structure 1002 and the two tanks 600 which are mounted to opposed ends of the core structure 1002. As has been mentioned hereinabove, the core structure 1002 comprises a plurality of parallel flat tubes and a plurality of corrugated fins, which extend between the two tanks 600. Each tank 600 is provided at its upper and lower ends with pins 142.

Although the invention has been described above by reference to certain embodiments of the invention and certain modifications of the embodiments, the invention is not limited to the embodiments and modifications described above. Further modifications and variations of the embodiments described above will occur to those skilled in the art, in light of the above teachings.

What is claimed is:

1. A tank of heat exchanger, comprising:

a tank body made of a metal, said tank body being shaped like a channel member including a base wall and opposed side walls between which said base wall extends; and a metal pipe member that is hermetically secured to one of said opposed side walls of said tank body by partially welding the metal pipe member to said one side wall and then brazing said metal pipe member to said one side wall, one of said opposed side walls having an opening, said metal pipe member being formed with a circular flange which is hermetically secured to said one side wall in a manner to provide a fluid communication between the interior of said tank body and the interior of said metal pipe member through said opening, said opening having a peripheral end that terminates at an inner surface of said base wall, and said circular flange having a part which is bent and secured to said base wall of the tank body.

2. A tank of heat exchanger as claimed in claim 1, wherein the height of said side wall opposing said one side wall attached to said metal pipe member is greater than an outer diameter of a central portion of said metal pipe member.

3. A tank of heat exchanger as claimed in claim 1, wherein a first distance from a center axis of said metal pipe member to a first end of said side wall formed with an opening is greater than a second distance from said center axis of said metal pipe member to a second end of said side wall formed with an opening.

4. A tank as claimed in claim 1, in which said opening extends to a given portion of said base wall of said tank body, and in which said part of the circular flange is raised and swelled to provide a fluid communication between the interior of said tank body and the interior of said pipe member through said open given portion.

5. A tank as claimed in claim 1, in which said metal member is a header plate member to which a core structure of the heat exchanger is fixed, said header plate member being formed along side edges thereof respective flanges which are in contact with inner surfaces of leading ends of the respective side walls of said tank body, said respective flanges being secured to said leading ends of said respective side walls by partially welding said respective flanges to said leading ends and then brazing said respective flanges to said leading ends.

6. A tank as claimed in claim 5, in which the incomplete fixing of the respective flanges of said header plate member is carried out by a spot welding.

7. A tank as claimed in claim 6, which said spot welding is achieved by contacting electrodes onto outer surfaces of the leading ends of the respective side walls of said tank body.

8. A tank as claimed in claim 1, in which said metal member is an end plate that is hermetically secured to a longitudinal end of said tank body by incompletely fixing said end plate to said longitudinal end and then brazing said end plate to said longitudinal end, the incomplete fixing of the end plate to said longitudinal end being carried out by providing the end plate with ridges, pressing the ridges of said end plate against said longitudinal end and applying a given voltage between said end plate and said tank body to fuse the ridges.

9. A tank as claimed in claim 8, in which said ridges extend in parallel with each other, so that when said end plate is attached to said longitudinal end of said tank body, each ridge extends between the ends of the opposed side walls of said tank body.

10. A tank as claimed in claim 8, further comprising a header plate member to which a core structure of the heat exchanger is fixed, said header plate member being formed along side edges thereof respective flanges which are in contact with inner surfaces of leading ends of the respective side walls of said tank body, said respective flanges being hermetically secured to said leading ends of said respective side walls by partially welding said respective flanges to said leading ends and then brazing said respective flanges to said leading ends.

11. A tank as claimed in claim 10, in which said ridges of said end plate extend in parallel with each other, so that when said end plate is attached to said longitudinal end of said tank body, one ridge extends between the ends of the opposed side walls of said tank body and the other ridge extends between the ends of said flanges of said header plate member as well as the ends of the opposed side walls of said tank body.

12. A tank as claimed in claim 10, in which said ridges of said end plate extend in parallel with each other, so that when said end plate is attached to said longitudinal end of said tank body, each of said ridges extends between the end of said base wall of said tank body and the end of said header plate member.

13. A tank as claimed in claim 10, in which said ridges of said end plate are arranged to cross, so that when said end plate is attached to said longitudinal end of said tank body, one straight ridge extends between the ends of the side walls of said tank body and the other straight ridge extends between the end of said base wall of said tank body and the end of said header plate member.

14. A tank as claimed in claim 10, in which said ridges of said end plate are arranged to constitute a generally T-shaped ridge which includes a first ridge part and a second ridge part, so that when the end plate is attached to said longitudinal end of said tank body, said first ridge part extends between the ends of the side walls of said tank body and said second ridge part extends between said first ridge part and the end of said header plate member.

15. A tank as claimed in claim 10, in which said ridges of said end plate are separated from one another, so that when said end plate is attached to said longitudinal end of said tank body, one of said ridges extends to the end of the base wall of said tank body and the other two ridges extend to the end of said head plate member.

16. A tank as claimed in claim 8, further comprising a core structure which is connected to said tank body and an elongate cover plate which has flanges and covers a longitudinally extending open portion of said tank body, said core structure and said elongate cover plate being hermetically secured to said tank body by being partially welded to given portions of said tank body and then brazed to said given portions.

17. A tank as claimed in claim 16, in which when said end plate is hermetically attached to said longitudinal end of said tank body, one ridge extends between ends of said flanges as well as the ends of the opposed side walls of said tank body and the other ridge extends between the ends of the side walls of said tank body.

18. A tank as claimed in claim 1, in which said metal member is a cylindrical hollow pin that is hermetically secured to the base wall of said tank body by partially welding said pin to said base wall and then brazing said pin to said base wall, the partial welding of the pin to said base plate being carried out by means of spot welding.

19. A tank as claimed in claim 8, further comprising a cylindrical hollow pin that is hermetically secured to said end plate by partially welding said pin to said end plate and then brazing said pin to said end plate, the partial welding of the pin to said end plate being carried out by means of spot welding.

20. A tank as claimed in claim 18, in which said cylindrical hollow pin comprises a cylindrical middle part, a head part and a circular flange part, said flange part being hermetically secured to said base wall of said tank body by means of spot welding and brazing.

21. A tank as claimed in claim 20, in which said head part of said cylindrical hollow pin is formed with an opening.

22. A tank as claimed in claim 20, in which said circular flange part of said pin is arranged to surround a projection formed on said base wall of the tank body.

23. A tank as claimed in claim 20, in which said circular flange part of said pin is neatly received in a recess formed on said base wall of the tank body.

24. A tank of heat exchanger, comprising:

a tank body made of a clad aluminum plate, said tank body being shaped like a channel member including a base wall and opposed side walls between which the base wall extends;

a circular opening formed in one of said side walls;

a pipe member of a clad aluminum plate, said pipe member having a single circular flange which is brazed to said one of said side walls in a manner to provide a fluid communication between the interior of said tank body and the interior of said pipe member through said circular opening;

a header plate member of clad aluminum plate to which a core structure of the heat exchanger is connected, said header plate member having therealong respective flanges, said header plate member covering a longitudinally extending open portion of said tank body by having the flanges thereof brazed to inner surfaces of said opposed side walls of said tank body;

end plates of clad aluminum plate, which are brazed to longitudinal ends of said tank body; and a filler neck member fixed to said base wall of said tank body in such a manner as to provide a fluid communication between the interior of said tank body and the interior of said filler neck member through an opening formed in said base wall.

25. A tank of heat exchanger, comprising:

a tank body made of a metal, said tank body being shaped to have a substantially rectangular cross section including a base wall having opposed side ends from which opposed side walls extend from the same side of said base wall; and a metal pipe member that is hermetically secured to one of said opposed side walls of said tank body by partially welding the metal pipe member to said one side wall and then brazing said metal pipe member to said one side wall, said one side wall having an opening, said metal pipe member being formed with a flange which is hermetically secured to said one side wall in a manner to provide a fluid communication between the interior of said tank body and the interior of said metal pipe member through said opening, said opening having a peripheral end that terminates at an inner surface of said tank, and said flange being circular in shape and having a part of the flange secured to said base wall of the tank body.

26. A tank of heat exchanger as claimed in claim 25, wherein the height of said side wall opposing said one side wall attached to said metal pipe member is greater than an outer diameter of a central portion of said metal pipe member.

27. A tank of heat exchanger as claimed in claim 25, wherein a first distance from a center axis of said metal pipe member to a first end of said side wall formed with an opening is greater than a second distance from said center axis of said metal pipe member to a second end of said side wall formed with an opening.

* * * * *